US008456360B2

(12) United States Patent
Manasson et al.

(10) Patent No.: US 8,456,360 B2
(45) **Date of Patent: *Jun. 4, 2013**

(54) BEAM-FORMING ANTENNA WITH AMPLITUDE-CONTROLLED ANTENNA ELEMENTS

(75) Inventors: Vladimir A. Manasson, Irvine, CA (US); Lev S. Sadovnik, Irvine, CA (US)

(73) Assignee: Sierra Nevada Corporation, Sparks, NV (US)

( * ) Notice: Subject to any disclaimer, the term of this patent is extended or adjusted under 35 U.S.C. 154(b) by 219 days.

This patent is subject to a terminal disclaimer.

(21) Appl. No.: 12/981,326

(22) Filed: Dec. 29, 2010

(65) Prior Publication Data

US 2011/0140965 A1 Jun. 16, 2011

Related U.S. Application Data

(63) Continuation-in-part of application No. 12/253,790, filed on Oct. 17, 2008, now Pat. No. 7,864,112, which is a continuation of application No. 11/201,680, filed on Aug. 11, 2005, now Pat. No. 7,456,787.

(51) Int. Cl.
*H01Q 3/00* (2006.01)

(52) U.S. Cl.
USPC ..... 342/372

(58) Field of Classification Search
USPC ..... 342/372
See application file for complete search history.

(56) References Cited

U.S. PATENT DOCUMENTS 2,286,839 A 6/1942 Schelkunoff
2,415,933 A 2/1947 Brown
3,460,145 A 8/1969 Johnson
3,766,559 A 10/1973 Butcher, Jr. et al.
3,780,372 A 12/1973 Unz
3,916,417 A 10/1975 Wong et al.
3,990,077 A 11/1976 Beaulieu et al.
4,180,817 A 12/1979 Sanford
4,309,769 A 1/1982 Taylor, Jr.
4,559,605 A 12/1985 Norsworthy
4,580,141 A 4/1986 Gutleber
5,003,314 A 3/1991 Berkowitz et al.
5,053,983 A 10/1991 Hyatt
5,339,086 A 8/1994 DeLuca et al.
5,479,177 A 12/1995 Rudish et al.
5,493,306 A 2/1996 Rudish et al.
5,543,805 A 8/1996 Thaniyavarn (Continued)

OTHER PUBLICATIONS

Yian Chang et. al., Dec. 1996, IEEE Photonics Technology Letters, vol. 8, No. 12.

(Continued)

*Primary Examiner* — Harry Liu
(74) *Attorney, Agent, or Firm* — Klein, O'Neill & Singh, LLP

(57) ABSTRACT

A beam-forming antenna for transmission and/or reception of an electromagnetic signal having a given wavelength in a surrounding medium includes a transmission line electromagnetically coupled to an array of individually controllable antenna elements, each of which is oscillated by the signal with a controllable amplitude. The oscillation amplitude of each of the individual antenna elements is controlled by a switch. The antenna elements are arranged in various shapes such as a parabolic arc, a circular arc, a cylindrical surface or a conic surface. The antenna elements have various spacing such as uniform, parabolic, circular, or raised cosine.

36 Claims, 23 Drawing Sheets

U.S. PATENT DOCUMENTS

| | | | | |
|---|---|---|---|---|
| 5,734,345 | A | 3/1998 | Chen et al. | |
| 5,748,146 | A * | 5/1998 | Grove et al. | 342/372 |
| 5,751,248 | A | 5/1998 | Thaniyavarn | |
| 6,232,920 | B1 | 5/2001 | Brookner et al. | |
| 6,332,920 | B1 * | 12/2001 | Noik et al. | 106/692 |
| 6,466,165 | B2 | 10/2002 | Obayashi | |
| 6,583,760 | B2 | 6/2003 | Martek et al. | |
| 6,900,775 | B2 | 5/2005 | Shapira | |
| 7,034,760 | B2 | 4/2006 | Nakamura | |
| 2002/0154687 | A1 | 10/2002 | Bierly et al. | |
| 2002/0171583 | A1 | 11/2002 | Purdy et al. | |
| 2003/0043071 | A1 | 3/2003 | Lilly et al. | |
| 2005/0057421 | A1 | 3/2005 | Mohamadi | |
| 2005/0088337 | A1 | 4/2005 | Lorenz | |
| 2007/0024840 | A1 | 2/2007 | Fetzer et al. | |

OTHER PUBLICATIONS

Yian Chang et. al., Mar. 1997, IEEE Microwave and Guided Wave Letters, vol. 7, No. 3.

R.C. Johnson, H. Jasik; "Antenna Engineering Handbook"; 1984; McGraw Hill Book Company; New York; XP002402376; pp. 3-7.

* cited by examiner

BEAM-FORMING ANTENNA WITH AMPLITUDE-CONTROLLED ANTENNA ELEMENTS

CROSS-REFERENCE TO RELATED APPLICATION

The present application is a continuation-in-part of U.S. patent application Ser. No. 12/253,790, filed Oct. 17, 2008 now U.S. Pat.No. 7,864,112, which is a continuation of U.S. patent application Ser. No. 11/201,680, filed Aug. 11, 2005, now U.S. Pat. No. 7,456,787, both titled BEAM-FORMING ANTENNA WITH AMPLITUDE-CONTROLLED ANTENNA ELEMENTS, the disclosures of which are hereby incorporated by reference as if set forth in full herein.

FEDERALLY SPONSORED RESEARCH OR DEVELOPMENT

Not Applicable

BACKGROUND

This invention relates generally to the field of directional antennas for transmitting and/or receiving electromagnetic radiation, particularly (but not exclusively) microwave and millimeter wavelength radiation. More specifically, the invention relates to a composite beam-forming antenna comprising an array of antenna elements, wherein the shape of the transmitted or received beam is determined by controllably varying the effective oscillation amplitude of individual antenna elements. In the context of this invention, the term "beam shape" encompasses the beam direction, which is defined as the angular location of the power peak of the transmitted/received beam with respect to at least one given axis, the beamwidth of the power peak, and the side lobe distribution of the beam power curve.

Beam-forming antennas that allow for the transmission and/or reception of a highly directional electromagnetic signal are well-known in the art, as exemplified by U.S. Pat. No. 6,750,827; U.S. Pat. No. 6,211,836; U.S. Pat. No. 5,815,124; and U.S. Pat. No. 5,959,589. These exemplary prior art antennas operate by the evanescent coupling of electromagnetic waves out of an elongate (typically rod-like) dielectric waveguide to a rotating cylinder or drum, and then radiating the coupled electromagnetic energy in directions determined by surface features of the drum. By defining rows of features, wherein the features of each row have a different period, and by rotating the drum around an axis that is parallel to that of the waveguide, the radiation can be directed in a plane over an angular range determined by the different periods. This type of antenna requires a motor and a transmission and control mechanism to rotate the drum in a controllable manner, thereby adding to the weight, size, cost, and complexity of the antenna system.

Other approaches to the problem of directing electromagnetic radiation in selected directions include gimbal-mounted parabolic reflectors, which are relatively massive and slow, and phased array antennas, which are very expensive, as they require a plurality of individual antenna elements, each equipped with a costly phase shifter.

There has therefore been a need for a directional beam antenna that can provide effective and precise directional transmission as well as reception, and that is relatively simple and inexpensive to manufacture.

SUMMARY OF THE INVENTION

Broadly, the present invention is a reconfigurable, directional antenna, operable for both transmission and reception of electromagnetic radiation (particularly microwave and millimeter wavelength radiation), that comprises a transmission line that is electromagnetically coupled to an array of individually controllable antenna elements, each of which is oscillated by the transmitted or received signal with a controllable amplitude.

More specifically, for each beam-forming axis, the antenna elements are arranged in a linear array and are spaced from each other by a distance that is no greater than one-third the wavelength, in the surrounding medium, of the transmitted or received radiation. The oscillation amplitude of each of the individual antenna elements is controlled by an amplitude controlling device that may be a switch, a gain-controlled amplifier, a gain-controlled attenuator, or any functionally equivalent device known in the art. The amplitude controlling devices, in turn, are controlled by a computer that receives as its input the desired beamshape, and that is programmed to operate the amplitude controlling devices in accordance with a set of stored amplitude values derived empirically, by numerical simulations, for a set of desired beamshapes.

As will be more readily appreciated from the detailed description that follows, the present invention provides an antenna that can transmit and/or receive electromagnetic radiation in a beam having a shape and, in particular, a direction that can be controllably selected and varied. Thus, the present invention provides the beam-shaping control of a phased array antenna, but does so by using amplitude controlling devices that are inherently less costly and more stable than the phase shifters employed in phased array antennas.

DETAILED DESCRIPTION

Figure 1:
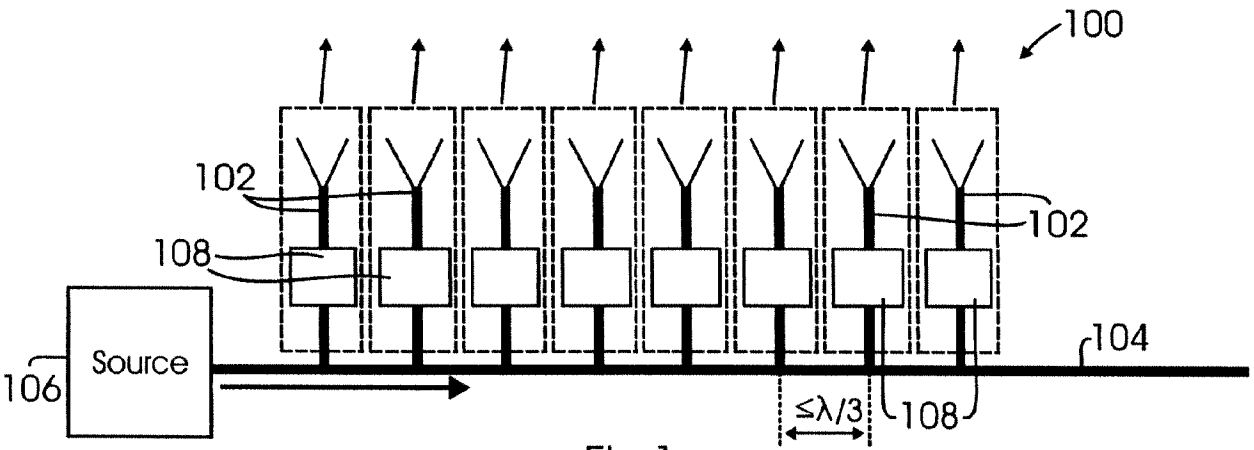
FIG. 1 is a schematic view of a beam-forming antenna in accordance with the present invention, in which the antenna is configured for transmission.
Figure 2:
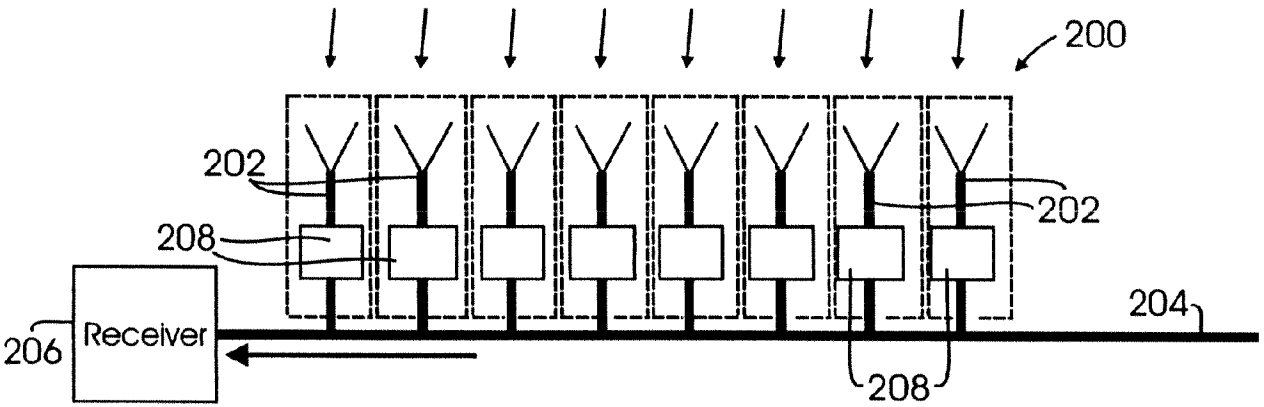
FIG. 2 is a schematic view of a beam-forming antenna in accordance with the present invention, in which the antenna is configured for reception.
Figure 3:
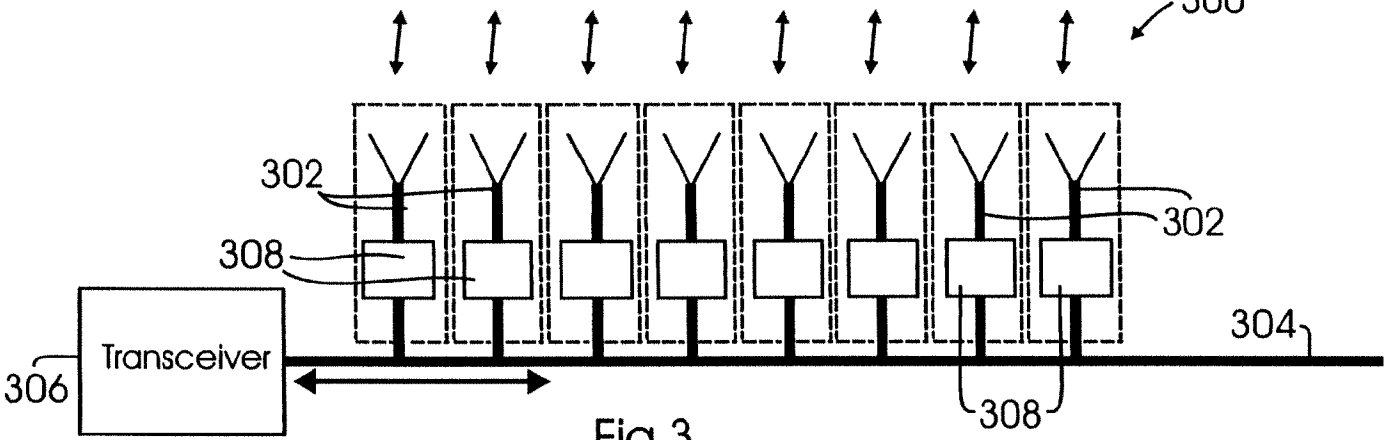
FIG. 3 is a schematic view of a beam-forming antenna in accordance with the present invention, in which the antenna is configured for both transmission and reception.

FIGS. 1, 2, and 3 respectively illustrate three configurations of a beam-forming antenna in accordance with a broad concept of the present invention. As will be described in more detail below, the beam-forming antenna in accordance with the present invention comprises at least one linear array of individual antenna elements, each of which is electromagnetically coupled to a transmission line through an amplitude controlling device, wherein the antenna elements are spaced from each other by a spacing distance that is less than or equal to one-third the wavelength, in the surrounding medium, of the electromagnetic radiation transmitted and/or received by the antenna. As shown in FIGS. 1, 2, and 3, the spacing distances between each adjacent pair of antenna elements may advantageously be equal, but as discussed below with respect to FIG. 4, these spacing distances need not be equal.

More specifically, FIG. 1 illustrates a beam-forming antenna 100 configured for transmitting a shaped beam of electromagnetic radiation in one direction (i.e., along one linear axis). The antenna 100 comprises a linear array of individual antenna elements 102, each of which is coupled (by means such as a wire, a cable, or a waveguide, or by evanescent coupling) to a transmission line 104, of any suitable type known in the art, that receives an electromagnetic signal from a signal source 106. The phase velocity of the electromagnetic signal in the transmission line 104 is less than the phase velocity in the medium (e.g., atmospheric air) in which the antenna 100 is located. Each of the antenna elements 102 is coupled to the transmission line 104 through an amplitude controlling device 108, so that the signal from the transmission line 104 is coupled to each of the antenna elements 102 through an amplitude controlling device 108 operatively associated with that antenna element 102.

FIG. 2 illustrates a beam-forming antenna 200 configured for receiving electromagnetic radiation preferentially from one direction. The antenna 200 comprises a linear array of individual antenna elements 202, each of which is coupled to a transmission line 204 that feeds the electromagnetic signal to a signal receiver 206. Each of the antenna elements 202 is coupled to the transmission line 204 through an amplitude controlling device 208, so that the signal from each of the antenna elements 202 is coupled to the transmission line 204 through an amplitude controlling device 208 operatively associated with that antenna element 202. The antenna 200 is, in all other respects, similar to the antenna 100 of FIG. 1.

FIG. 3 illustrates a beam-forming antenna 300 configured for both receiving a beam of electromagnetic radiation preferentially from one direction, and transmitting a shaped beam of electromagnetic radiation in a preferred direction. The antenna 300 comprises a linear array of individual antenna elements 302, each of which is coupled to a transmission line 304 that, in turn, is coupled to a transceiver 306. Each of the antenna elements 302 is coupled to the transmission line 304 through an amplitude controlling device 308, so that signal coupling between each antenna element 302 and the transmission line 304 is through an amplitude controlling device 308 operatively associated with that antenna element 302. The antenna 300 is, in all other respects, similar to the antennas 100 and 200 of FIGS. 1 and 2, respectively.

The amplitude controlling devices 108, 208, 308, of the antennas 100, 200, 300, respectively, may be switches, gain-controlled amplifiers, gain-controlled attenuators, or any suitable, functionally equivalent devices that may suggest themselves to those skilled in the pertinent arts. The electromagnetic signal transmitted and/or received by each antenna element 102, 202, 302 creates an oscillating signal within the antenna element, wherein the amplitude of the oscillating signal is controlled by the amplitude controlling device 108, 208, 308 operatively associated with that antenna element. The operation of the amplitude controlling devices, in turn, is controlled by a suitably programmed computer (not shown), as will be discussed below.

Figure 4:
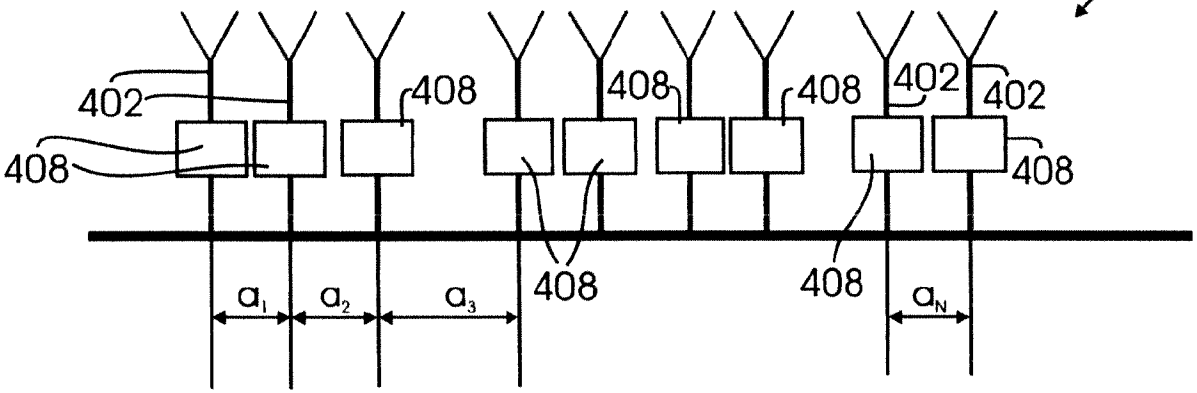
FIG. 4 is a schematic diagram of a beam-forming antenna in accordance with the present invention, in which the spacing distances between adjacent antenna elements are unequal.

FIG. 4 illustrates a beam-forming antenna 400, in accordance with the present invention, comprising a linear array of antenna elements 402 coupled to a transmission line 404 through an amplitude controlling device 408, as described above. In this variant of the invention, however, each adjacent pair of antenna elements 402 is separated by a spacing distance $a_1 \ldots a_N$, wherein the spacing distances may be different from each other, as long as all are less than or equal to one-third the wavelength of the electromagnetic signal in the surrounding medium, as mentioned above. The spacing distances may, in fact, be arbitrarily distributed, as long as this maximum distance criterion is met.

Figure 5:
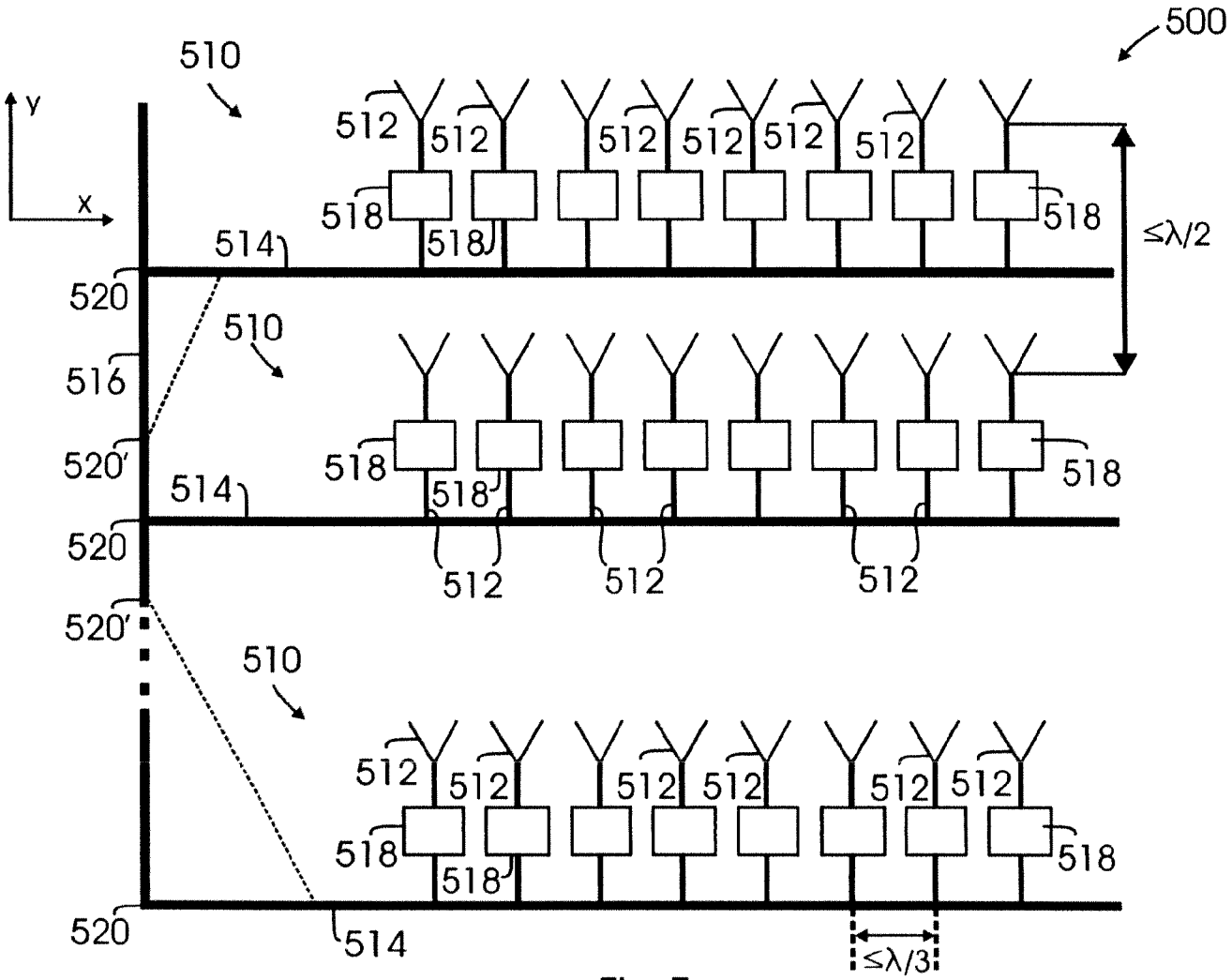
FIG. 5 is a schematic diagram of a plurality of beam-forming antennas in accordance with the present invention, wherein the antennas are arranged in a single plane, in parallel rows, to provide beam-shaping in three dimensions.

FIG. 5 illustrates a two-dimensional beam-forming antenna 500 that provides beam-shaping in three dimensions, the beam's direction being typically described by an azimuth angle and an elevation angle. The antenna 500 comprises a plurality of linear arrays 510 of individual antenna elements 512, wherein the arrays 510 are arranged in parallel and are coplanar. Each array 510 is coupled with a transmission line 514, and the transmission lines 514 are connected in parallel to a master transmission line 516 so as to form in a parallel transmission line network. Each antenna element 512 is coupled to its respective transmission line 514 through an amplitude controlling device 518. The phase of the signal fed to each of the transmission lines 514 is determined by the location on the master transmission line 516 at which each transmission line is coupled to the master transmission line 516. Thus, as shown in FIG. 5, in one specific example, a first phase value is provided by coupling the transmission lines 514 to the master transmission line 516 at a first set of coupling points 520, while in a second specific example, a second phase value may be provided by coupling the transmission lines 514 to the master transmission line 516 at a second set of coupling points 520' (shown at the ends of phantom lines). Each linear array 510 is constructed in accordance with one of the configurations described above with respect to FIGS. 1-4. As an additional structural criterion, in the two-dimensional configuration, the distance between adjacent arrays 510 is less than or equal to one-half the wavelength, in the surrounding medium, of the electromagnetic signal transmitted and/or received by the antenna 500.

FIGS. 6*a*, 6*b* through 11*a*, 11*b* graphically illustrate exemplary beam shapes produced by an antenna constructed in accordance with the present invention. In general, as mentioned above, the amplitude controlling devices, be they switches, gain-controlled amplifiers, gain-controlled attenuators, or any functionally equivalent device, are controlled by a suitably-programmed computer (not shown). The computer operates each amplitude controlling device to provide a specific signal oscillation amplitude in each antenna element, whereby the oscillation amplitudes that are distributed across the element antenna array produce the desired beam shape (i.e., power peak direction, beam width, and side lobe distribution).

One specific way of providing computer-controlled operation of the amplitude controlling devices is to derive empirically, by numerical simulation, sets of amplitude values for the antenna element array that correspond to the values of the beam shape parameters for each desired beam shape. A look-up table with these sets of amplitude values and beam shape parameter values is then created and stored in the memory of the computer. The computer is programmed to receive an input corresponding to the desired beam shape parameter values, and then to generate input signals that represent these values. The computer then looks up the corresponding set of amplitude values. An output signal (or set of output signals) representing the amplitude values is then fed to the amplitude controlling devices to produce an amplitude distribution along the array that produces the desired beam shape.

Figure 6A:
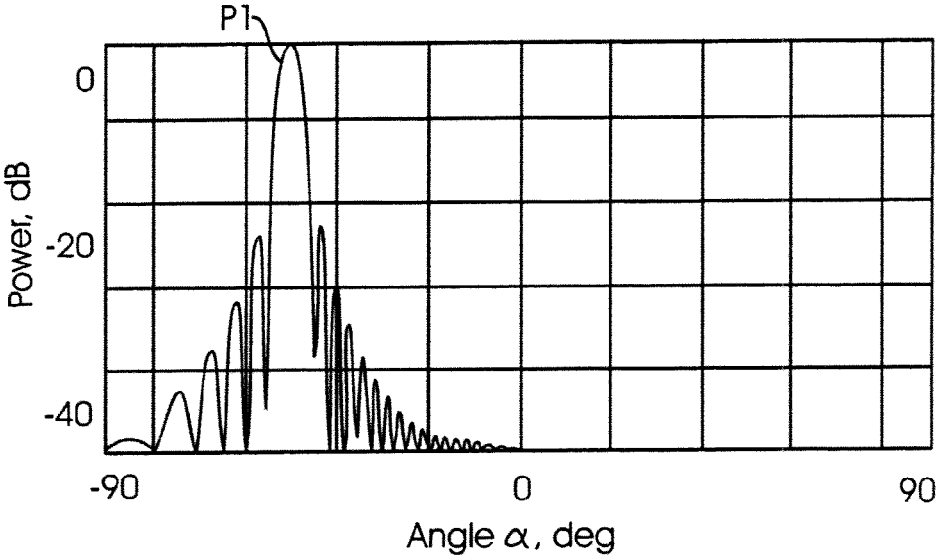
FIG. 6*a* is a first exemplary far-field beam shape produced by a beam-forming antenna in accordance with the present invention, wherein a denotes the azimuth angle.
Figure 6B:
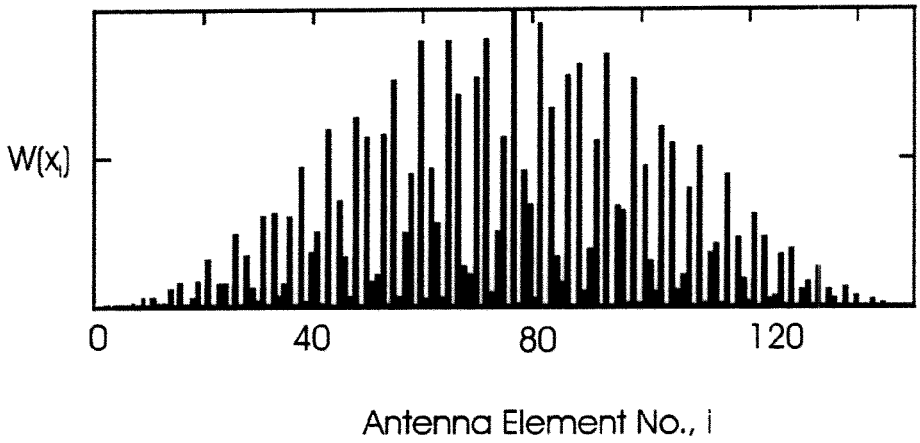
FIG. 6*b* is a graph of the RF power distribution for the array of antenna elements that results in the beam shape of FIG. 6*a;*

A first exemplary beam shape is shown in FIG. 6*a*, having a peak P1 at about −50° in the azimuth, with a moderate beam width and a side lobe distribution having a relatively gradual drop-off. The empirically-derived oscillation amplitude distribution (expressed as the RF power for each antenna element i) that produces the beam shape of FIG. 6*a* is shown in FIG. 6*b*.

Figure 7A:
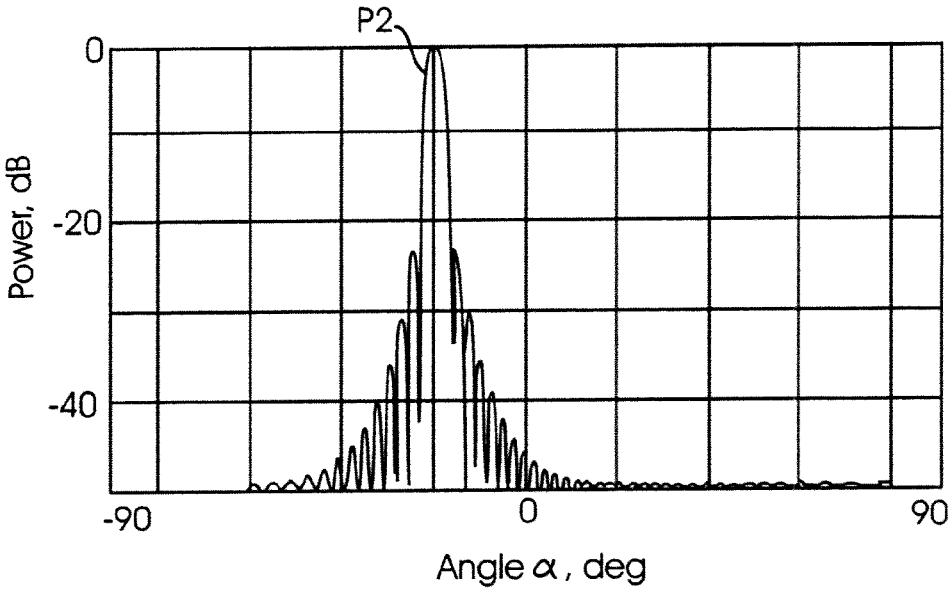
FIG. 7*a* is a second exemplary far-field beam shape produced by a beam-forming antenna in accordance with the present invention, wherein $\alpha$ denotes the azimuth angle.
Figure 7B:
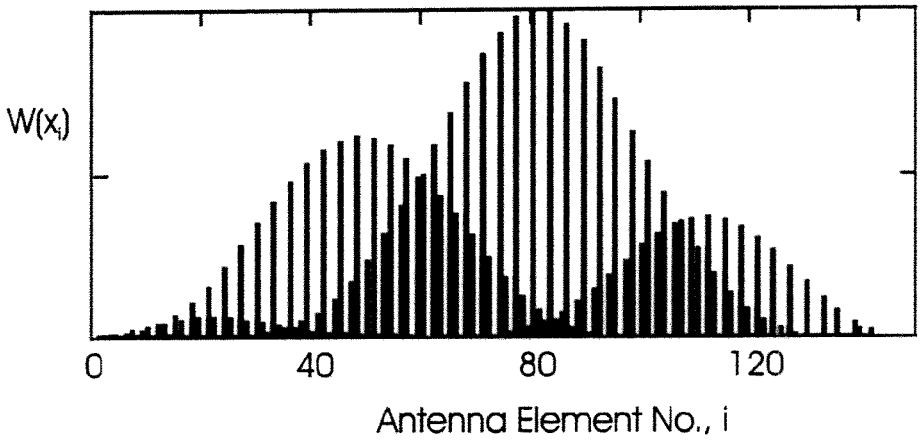
FIG. 7*b* is a graph of the RF power distribution for the array antenna elements that results in the beam shape of FIG. 7*a;*

A second exemplary beam shape is shown in FIG. 7*a*, having a peak P2 at about −20° in the azimuth, with a narrow beam width and a side lobe distribution having a relatively steep drop-off. The empirically-derived oscillation amplitude distribution that produces the beam shape of FIG. 7*a* is shown in FIG. 7*b*.

Figure 8A:
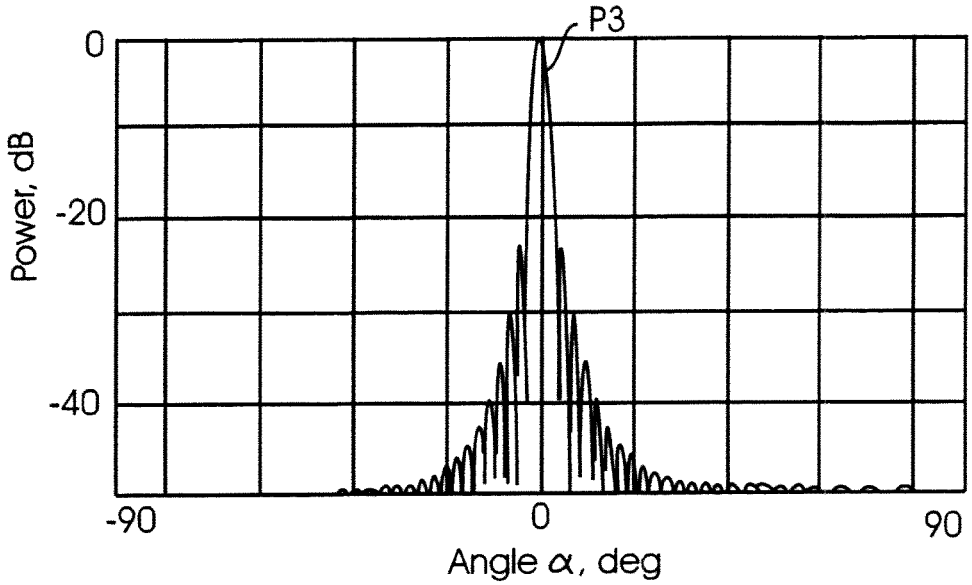
FIG. 8*a* is a third exemplary far-field beam shape produced by a beam-forming antenna in accordance with the present invention, wherein $\alpha$ denotes the azimuth angle.
Figure 8B:
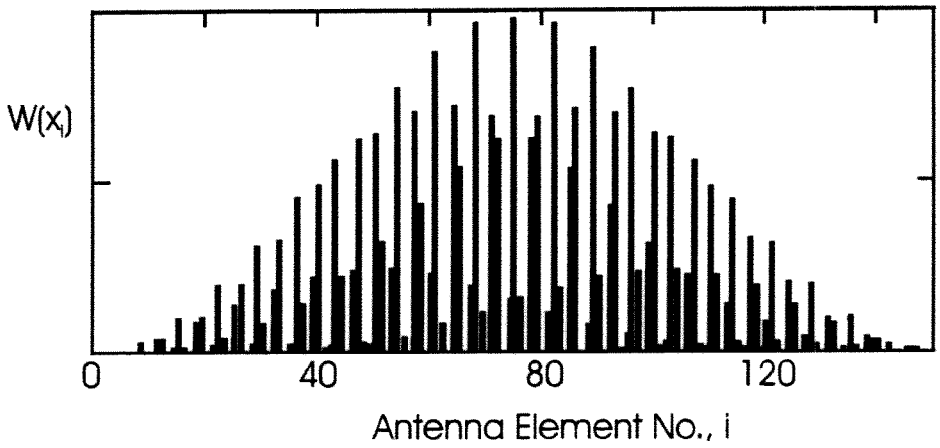
FIG. 8*b* is a graph of the RF power distribution for the array of antenna elements that results in the beam shape of FIG. 8*a;*

A third exemplary beam shape is shown in FIG. 8*a*, having a peak P3 at about 0° in the azimuth, with a narrow beam width and a side lobe distribution having a relatively steep drop-off. The empirically-derived oscillation amplitude distribution that produces the beam shape of FIG. 8*a* is shown in FIG. 8*b*.

Figure 9A:
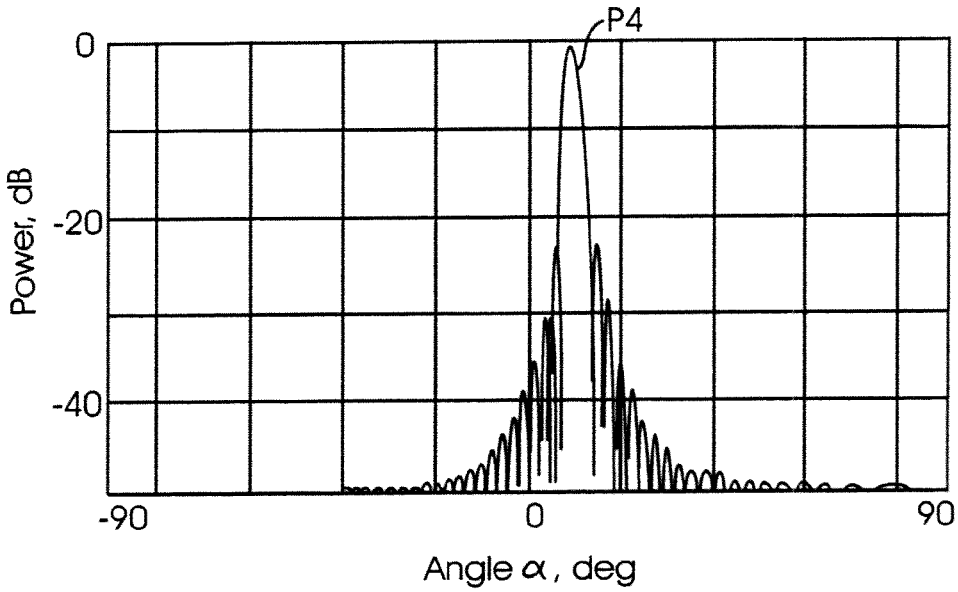
FIG. 9*a* is a fourth exemplary far-field beam shape produced by a beam-forming antenna in accordance with the present invention, wherein $\alpha$ denotes the azimuth angle.
Figure 9B:
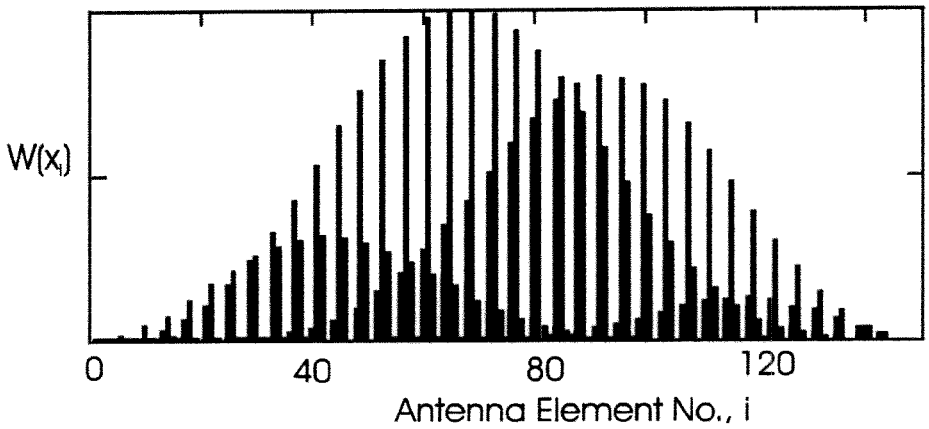
FIG. 9*b* is a graph of the RF power distribution for the array of antenna elements that results in the beam shape of FIG. 9*a;*

A fourth exemplary beam shape is shown in FIG. 9*a*, having a peak P4 at about +10° in the azimuth, with a moderate beam width and a side lobe distribution having a relatively steep drop-off. The empirically-derived oscillation amplitude distribution that produces the beam shape of FIG. 9*a* is shown in FIG. 9*b*.

Figure 10A:
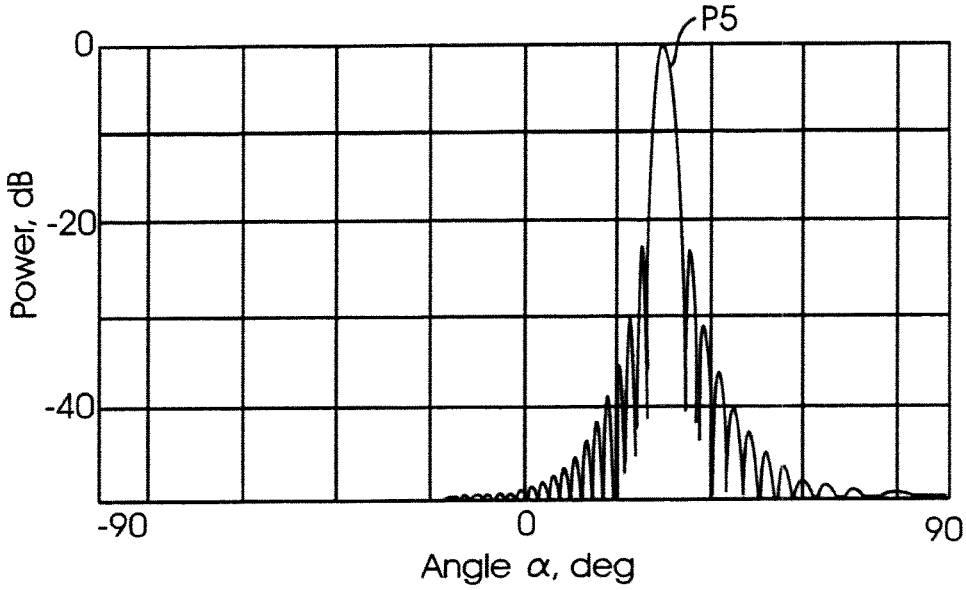
FIG. 10*a* is a fifth exemplary far-field beam shape produced by a beam-forming antenna in accordance with the present invention, wherein α denotes the azimuth angle.
Figure 10B:
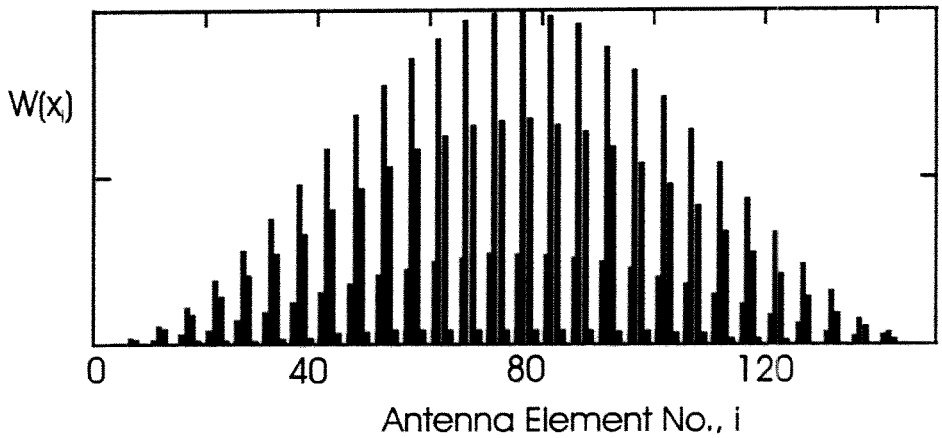
FIG. 10*b* is a graph of the RF power distribution for the array of antenna elements that results in the beam shape of FIG. 10*a;*

A fifth exemplary beam shape is shown in FIG. 10*a*, having a peak P5 at about +30° in the azimuth, with a moderate beam width and a side lobe distribution having a relatively steep drop-off. The empirically-derived oscillation amplitude distribution that produces the beam shape of FIG. 10*a* is shown in FIG. 10*b*.

Figure 11A:
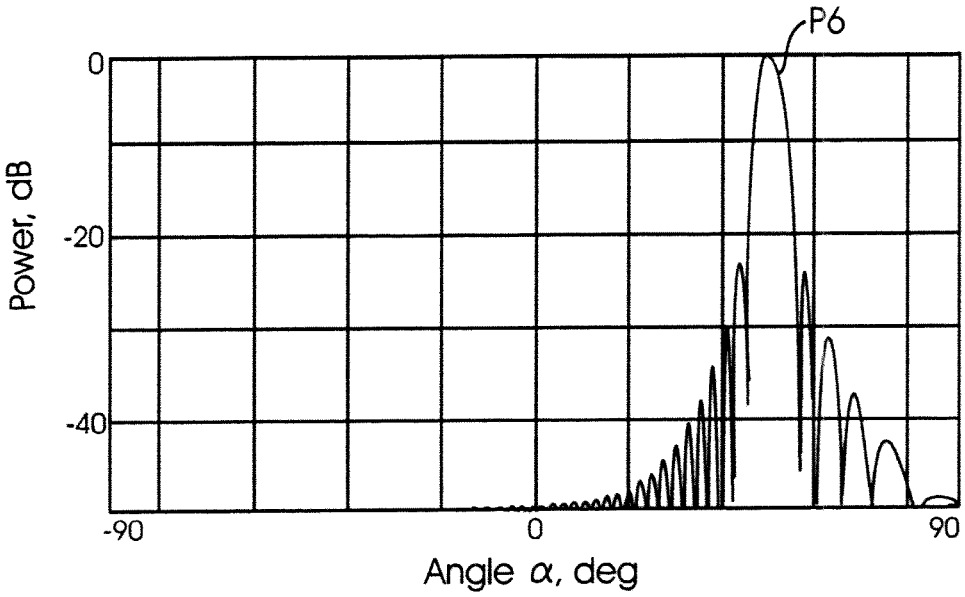
FIG. 11*a* is a sixth exemplary far-field beam shape produced by a beam-forming antenna in accordance with the present invention, wherein α denotes the azimuth angle.
Figure 11B:
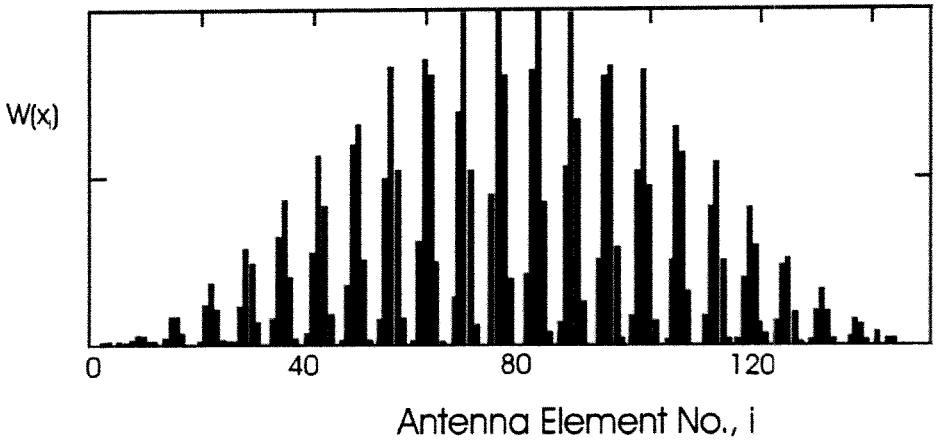
FIG. 11*b* is a graph of the RF power distribution for the array of antenna elements that results in the beam shape of FIG. 11*a;*

A sixth exemplary beam shape is shown in FIG. 11*a*, having a peak P6 at about +50° in the azimuth, with a relatively broad beam width and a side lobe distribution having a moderate drop-off. The empirically-derived oscillation amplitude distribution that produces the beam shape of FIG. 11*a* is shown in FIG. 11*b*.

Figure 12:
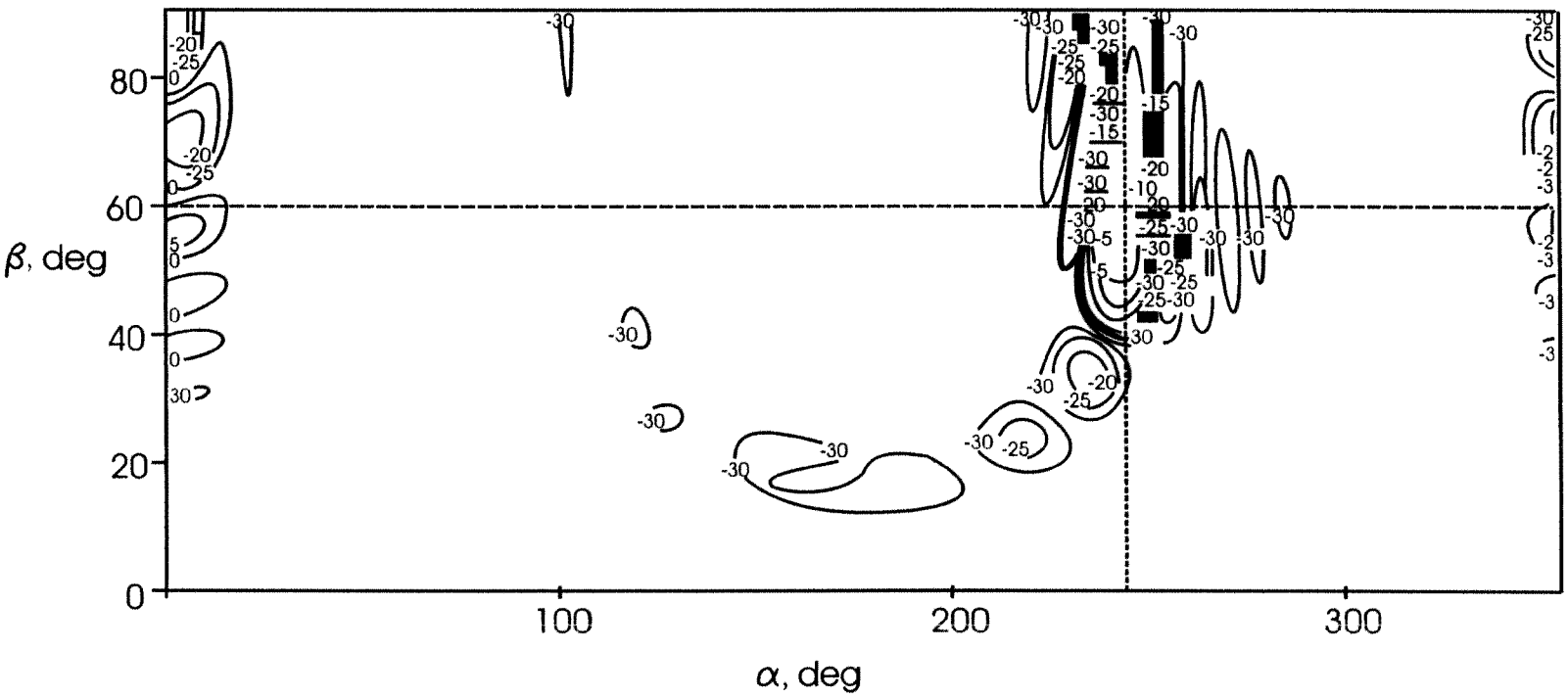
FIGS. 12-14 are graphs of exemplary far-field power distributions produced in three dimensions by a 2-dimensional beam-forming antenna in accordance with the present invention, wherein α represents azimuth and β represents elevation, and wherein the power contours on the graph are measured in dB.
Figure 13:
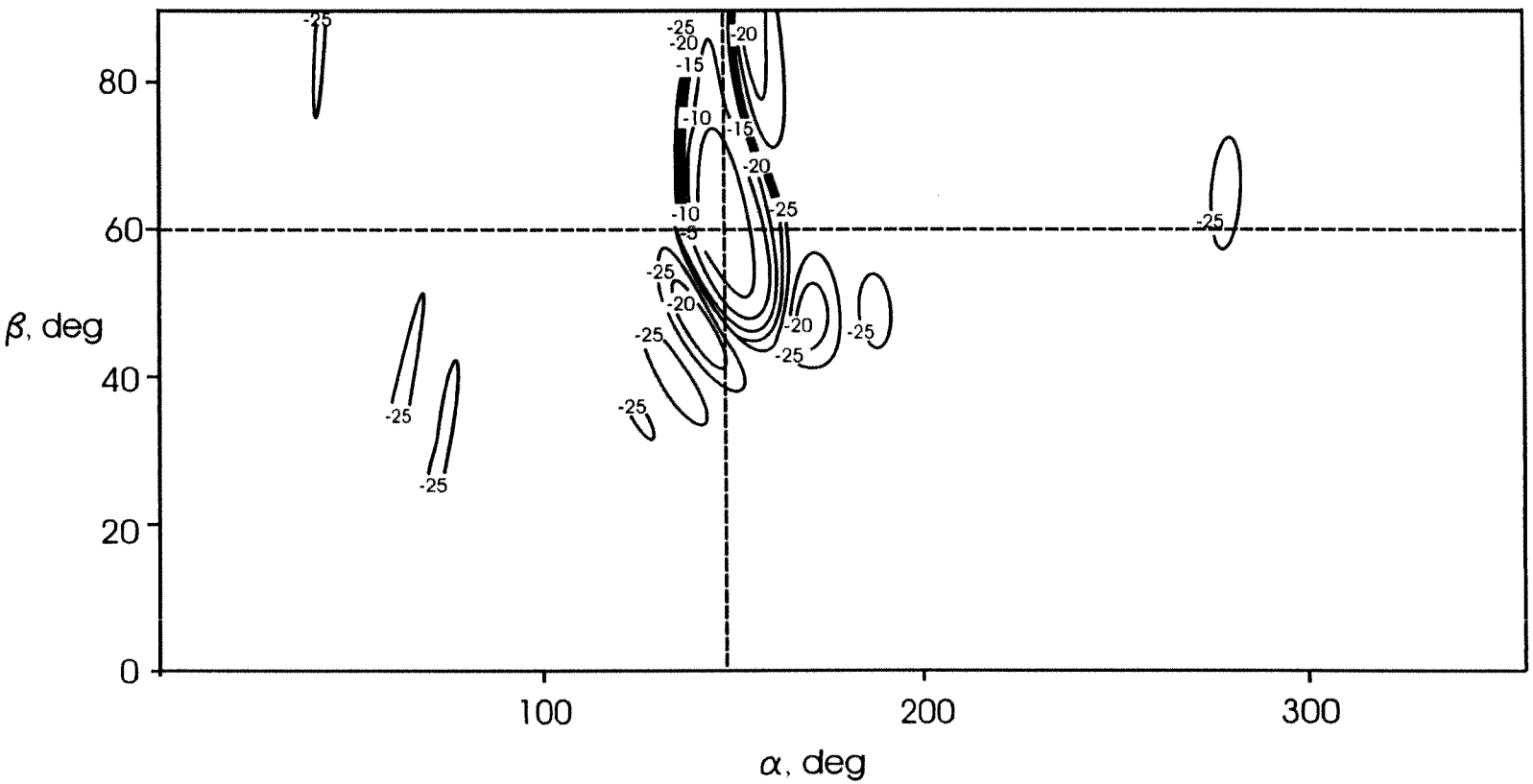
Figure 14:
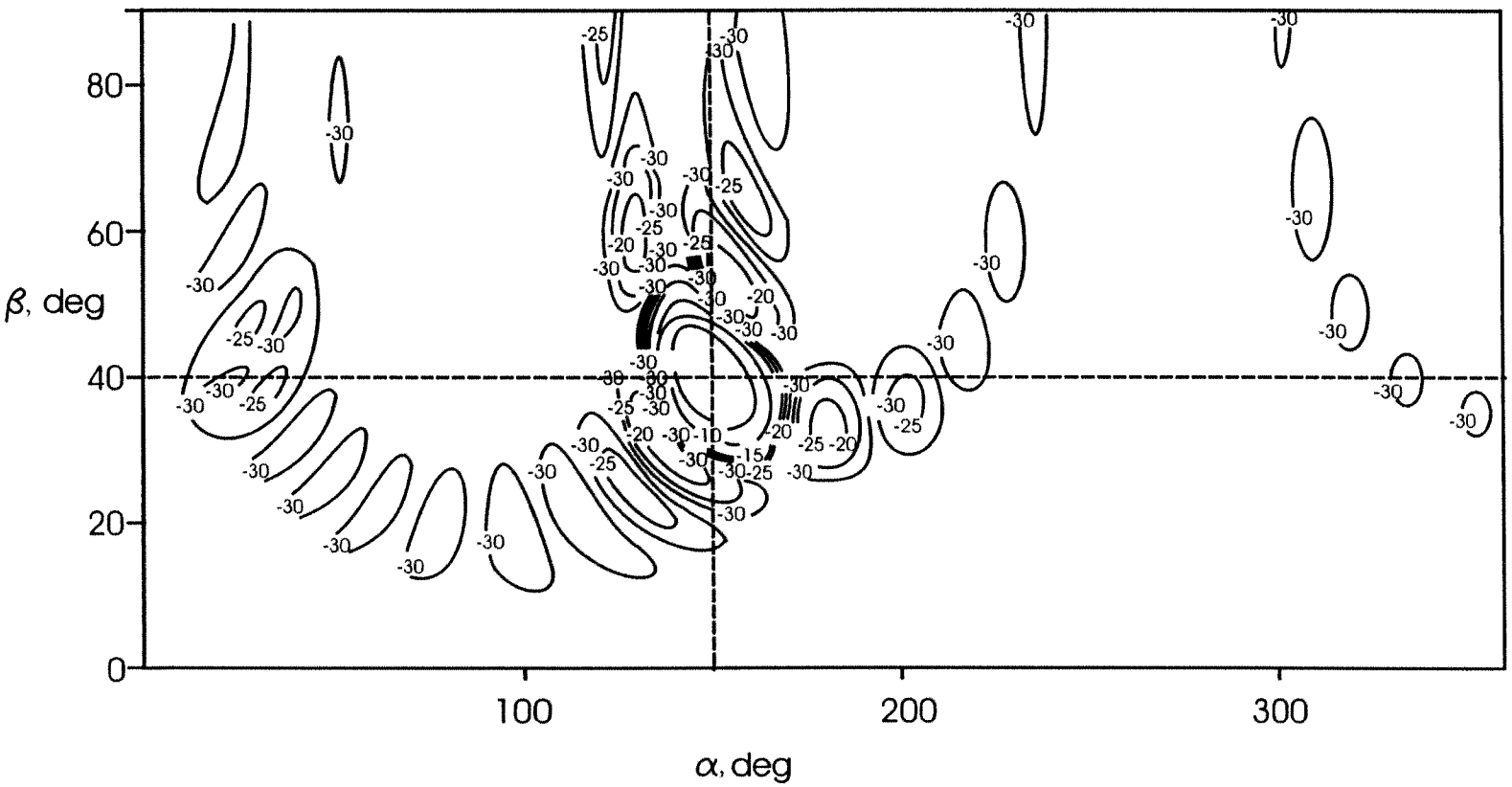

FIGS. 12-14 graphically illustrate exemplary far field power distributions produced by a two-dimensional beam-forming antenna, such as the antenna 500 described above and shown schematically in FIG. 5. In these graphs, the azimuth is labeled $\alpha$, and the elevation is labeled $\beta$. The power contours are measured in dB.

Figure 15:
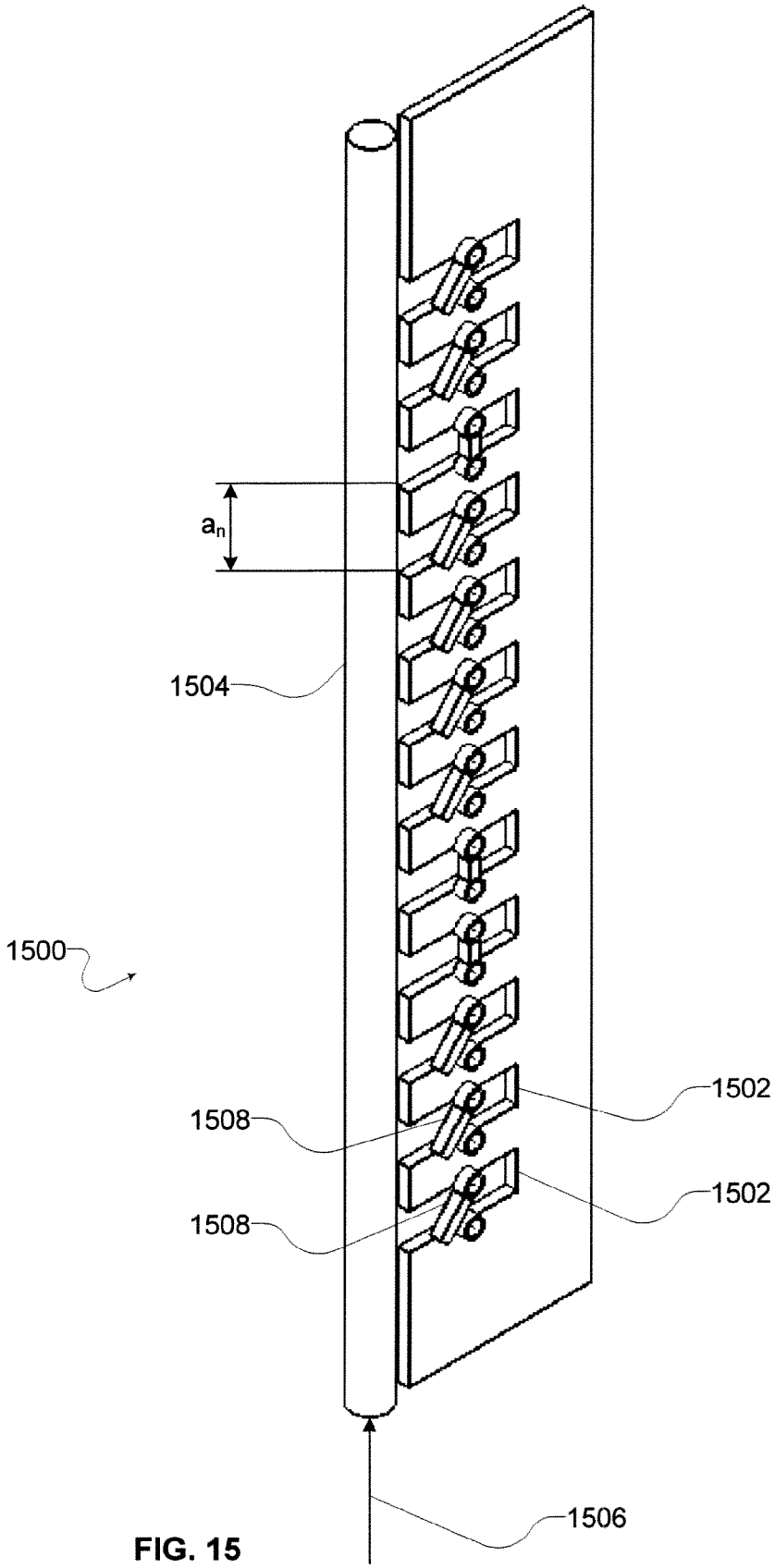
FIG. 15 is a semi-diagrammatic view of a beam-forming antenna in accordance with the present invention.

FIG. 15 is a semi-diagrammatic view of a beam-forming antenna 1500 in accordance with an aspect of the present invention. The antenna 1500 may be configured for transmitting electromagnetic radiation in a controlled direction and beam shape, receiving electromagnetic radiation with sensitivity having a controlled direction and shape, or both transmitting and receiving.

The antenna 1500 includes an array of individual antenna elements 1502. Although FIG. 15 illustrates a small number of antenna elements 1502, an implementation of the antenna 1500 may include a greater number, for example, hundreds. The antenna elements 1502 are coupled to a transmission line 1504, illustrated in FIG. 15 as a dielectric waveguide. The transmission line 1504 evanescently couples an electromagnetic signal 1506 to the antenna elements 1502 when the antenna is transmitting. When the antenna is receiving, the antenna elements 1502 evanescently couple an electromagnetic signal to the transmission line 1504.

Each of the antenna elements 1502 is coupled to the transmission line 1504 through an amplitude controlling switch 1508. Accordingly, the signal from the transmission line 1504 is coupled to each of the antenna elements 1502 with an amplitude controlled by one of switches 1508. The switches 1508 are illustrated schematically in FIG. 15. In various embodiments, the switches 1508 may be semiconductor switches, optical switches, solid state switches, or other types of switches that may be suitable for this application and that may suggest themselves to those skilled in the pertinent arts. The switches 1508 are digitally controlled so that there are a discrete number of amplitude levels. In many implementations, the switches 1508 are binary switches so that the amplitudes have two levels, nominally 0 and 1. Using binary switches allows for digital control of the amplitude, which may be more economical or cost effective to implement than the analog amplitude control described above. The states of the switches 1508 are generally computer controlled, with each switch set according to a desired beam shape and direction.

Each of the antenna elements 1502 is spaced from adjacent antenna elements by a distance $a_n$. The separation between elements may be termed a pitch or pixel spacing. Although the distances are illustrated in FIG. 15 as equal, in various embodiments the spacings vary with the location of the antenna elements 1502. As described above for the antennas of FIGS. 1-4, the pixel spacing is less than or equal to one-third the wavelength of the electromagnetic radiation transmitted or received by the antenna.

Figure 16A:
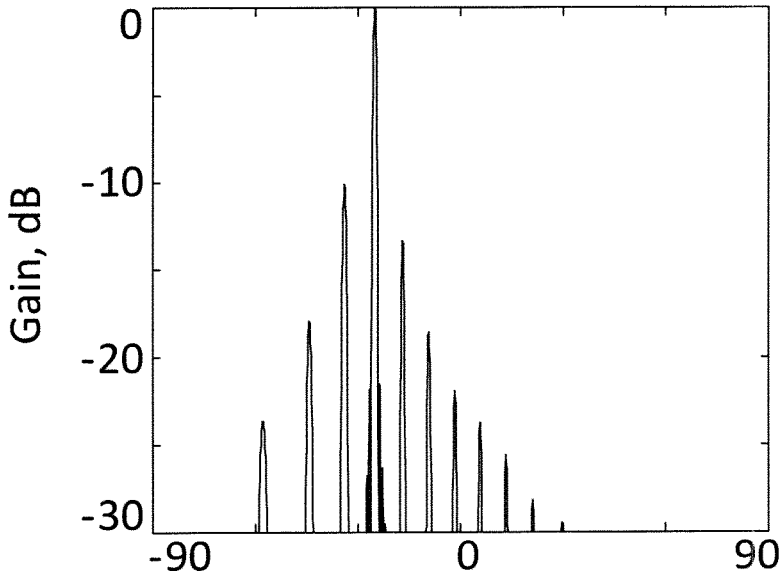
FIGS. 16*a-b* show exemplary far-field beam shapes produced by a beam-forming antenna in accordance with the present invention.
Figure 16B:
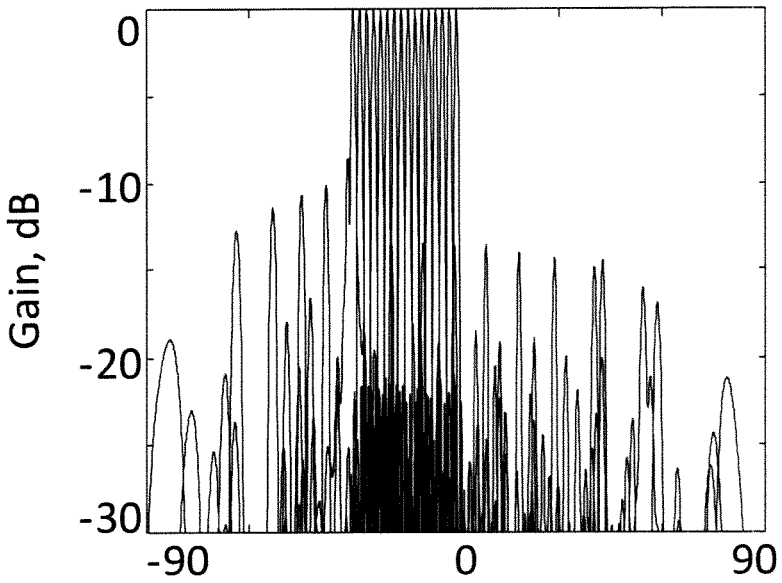

FIGS. 16*a* and 16*b* show exemplary far-field beam shapes produced by a beam-forming antenna as illustrated in FIG. 15 with uniform pixel pitch and binary switches. The particular exemplary antenna for which FIGS. 16*a* and 16*b* apply has a pixel pitch of approximately one-seventh the wavelength of the electromagnetic radiation, approximately 500 antenna elements, and a transmission line with a refractive index of approximately 1.35. FIG. 16*a* shows an exemplary beam shape, with an azimuth angle $\alpha$ on the x-axis and a gain in decibels on the y-axis, when the switches are set for a direction of −26°. In addition to the main lobe, there are additional side lobes, some of which are attenuated by only approximately 10 dB relative to the main lobe. These side lobes are due to quantization of switch amplitudes and thus may be termed quantization lobes or Q-lobes. The existence of relatively high magnitude Q-lobes may substantially degrade the performance of the antenna.

FIG. 16*b* illustrates exemplary far-field beam shapes for a scan of beam directions for the antenna having one beam shape illustrated in FIG. 16*a*. Sixteen beam directions separated by two degrees are superimposed in FIG. 16*b*. The Q-lobes vary in magnitude with beam direction, and many large lobes are present.

Figure 17:
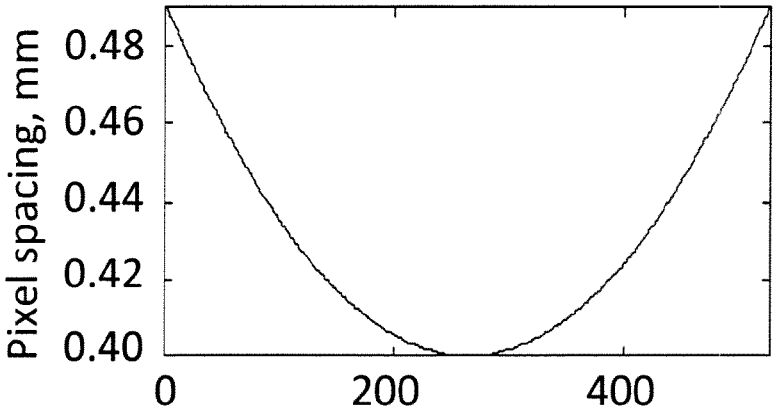
FIG. 17 is a graph of pixel spacings for a beam-forming antenna in accordance with one embodiment of the present invention.

Configuring the pixel spacings in the antenna of FIG. 15 to be non-uniform can reduce the magnitude of the Q-lobes. FIG. 17 is a graph of pixel spacings for an embodiment of a beam-forming antenna in which the antenna elements are arranged linearly between a first end (represented by the left end of the represented curve) and a second end (represented by the right end of the curve). The pixel spacings (spacing distances separating the antenna elements)vary in accordance with parabolic distribution between the first end and the second end. As shown in FIG. 17, the antenna elements at the center of the antenna have a minimum pixel spacing. The pixel spacing increases to a maximum at the first and second ends of the antenna. In other embodiments, the pixel spacing may be a maximum in the center of the antenna and a minimum at the first and second ends. In some embodiments, the pixel spacing may not be symmetrical about the center of the antenna. In all cases, as mentioned above, the spacing distances are all less than or equal to one-third of the wavelength of the electromagnetic wavelength transmitted or received by the antenna.

Figure 18A:
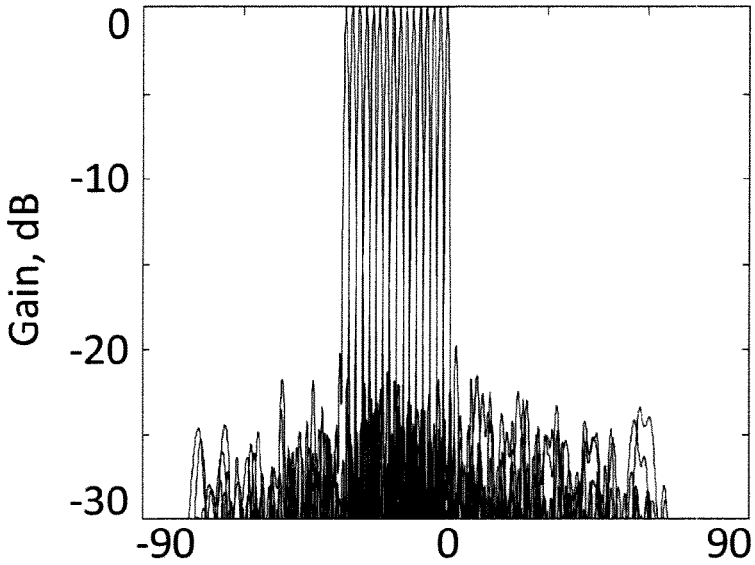
FIGS. 18*a-b* show exemplary far-field beam shapes produced by a beam-forming antenna having the pixel spacing of FIG. 18.
Figure 18B:
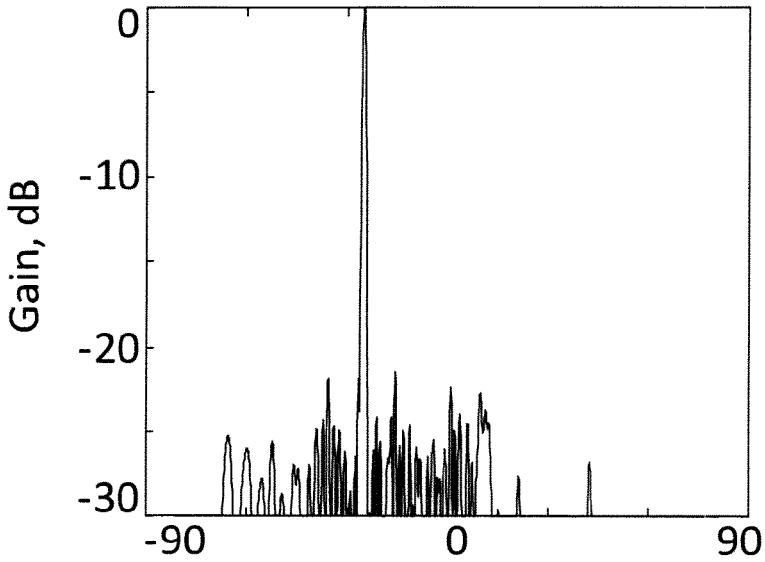

FIGS. 18*a* and 18*b* are exemplary far-field beam shapes produced by an exemplary beam-forming antenna having a parabolic pixel spacing as illustrated in FIG. 17. The particular exemplary antenna for which FIGS. 18*a* and 18*b* apply has an average pixel pitch of approximately one-seventh the wavelength of the electromagnetic radiation, approximately 500 antenna elements, binary switches, and a transmission line with a refractive index of approximately 1.35. FIG. 18*a* shows an exemplary beam shape, with an azimuth angle $\alpha$ on the x-axis and a gain in decibels on the y-axis, when the switches are set for a direction of −26°. In addition to the main lobe, there are additional side lobes. The magnitudes of the side lobes are greater than 20 dB attenuated relative to the main lobe. FIG. 18*b* illustrates exemplary far-field beam shapes for a scan of beam directions using the antenna having one beam shape illustrated in FIG. 18*a*. Sixteen beam directions separated by two degrees are superimposed in FIG. 18*b*. With reference to FIGS. 16*a-b*, it is seen that Q-lobe attenuation is improved by more than 10 dB using parabolic pixel spacing relative to using uniform pixel spacing.

Figure 19:
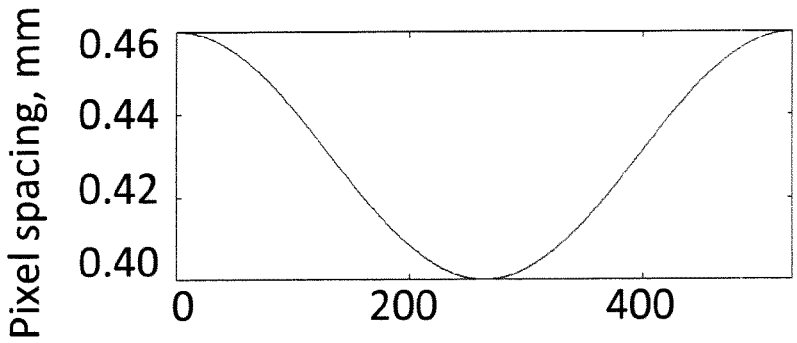
FIG. 19 is a graph of pixel spacings for a beam-forming antenna in accordance with another embodiment of the present invention.

FIG. 19 is a graph of pixel spacings for another embodiment of a beam-forming antenna in which the antenna elements are arranged linearly between a first end (represented by the left end of the represented curve) and a second end (represented by the right end of the curve). The pixel spacings (spacing distances separating the antenna elements) vary with location according to a sinusoidal distribution between the first end and the second end. As shown in FIG.19, the antenna elements at the center of the antenna have a minimum pixel spacing. The pixel spacing increases to a maximum at the first and second ends of the antenna. In other embodiments, the pixel spacing may be a maximum in the center of the antenna and a minimum at the first and second ends, and, in some embodiments, the pixel spacing may not be symmetrical about the center of the antenna. In all cases, as mentioned above, the spacing distances are all less than or equal to one-third of the wavelength of the electromagnetic wavelength transmitted or received by the antenna.

Figure 20A:
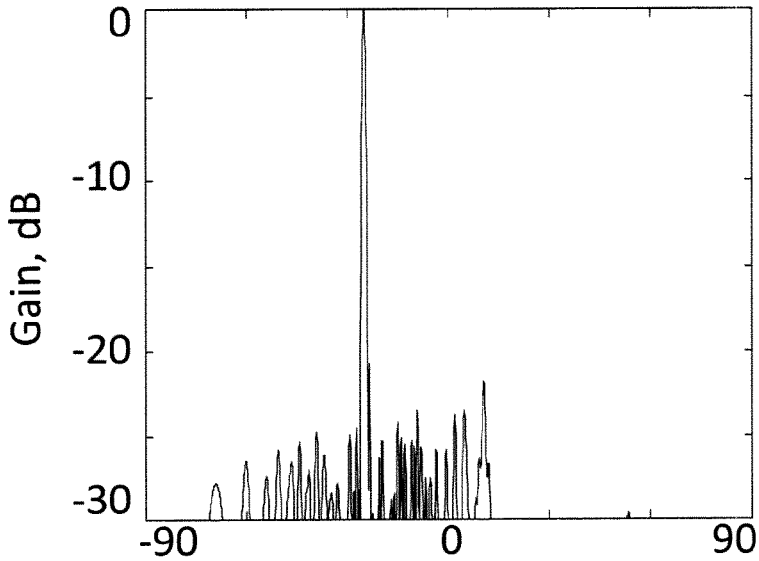
FIGS. 20*a-b* show exemplary far-field beam shapes produced by a beam-forming antenna having the pixel spacing of FIG. 19.
Figure 20B:
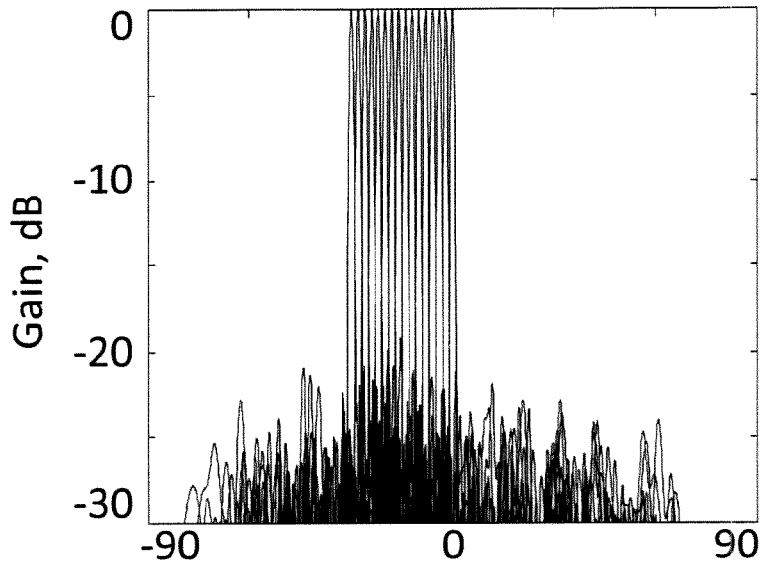

FIGS. 20*a* and 20*b* are exemplary far-field beam shapes produced by an exemplary beam-forming antenna having a raised cosine pixel spacing as illustrated in FIG. 19. The particular exemplary antenna for which FIGS. 20*a* and 20*b* apply has the same general characteristics as the exemplary antenna described for FIG. 17. FIG. 20*a* shows an exemplary beam shape when the switches are set for a direction of −26°. As shown, the magnitudes of the side lobes are greater than 20 dB attenuated relative to the main lobe. FIG. 20*b* illustrates exemplary far-field beam shapes for a scan of beam directions using the antenna having one beam shape illustrated in FIG. 20*a*. Q-lobe attenuation is improved by more than 10 dB using raised cosine pixel spacing relative to uniform pixel spacing.

Figure 21:
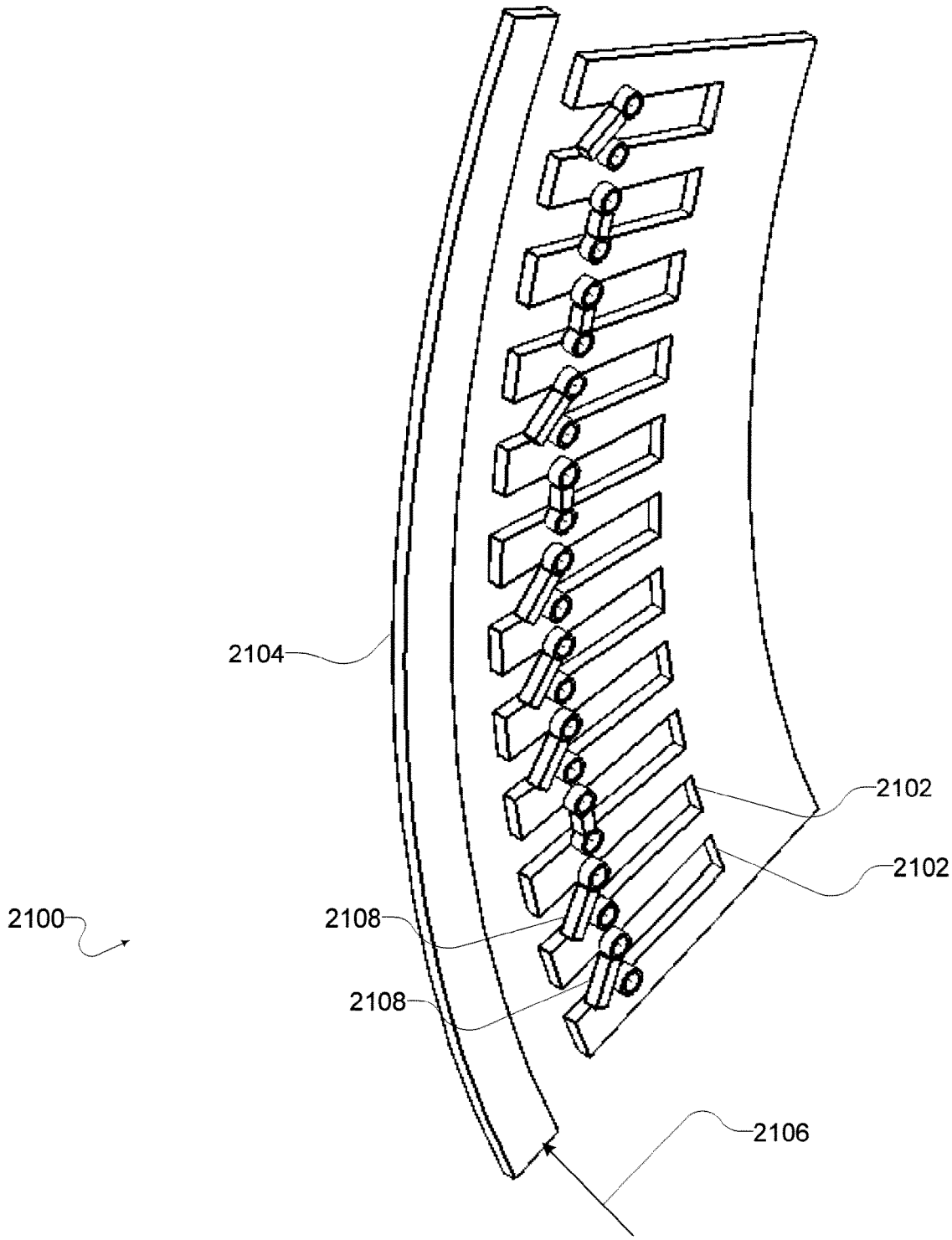
FIG. 21 is a semi-diagrammatic view of a beam-forming antenna in accordance with still another embodiment of the present invention.

FIG. 21 is a semi-diagrammatic view of another embodiment of a beam-forming antenna 2100 in accordance with an aspect of the present invention. The antenna 2100, like the previously-described antennas, may be configured for transmitting electromagnetic radiation in a controlled direction and shape, receiving electromagnetic radiation with sensitivity having a controlled direction and shape, or both transmitting and receiving. In some applications, it may be advantageous, due to costs or other factors, to have an antenna with uniform pixel spacing, but that still provides good attenuation of the Q-lobes. The antenna 2100 is illustrative of such an antenna.

The antenna 2100 includes an array of individual antenna elements 2102 that are evanescently coupled to a transmission line 2104, as in the previously described embodiments, whereby an electromagnetic signal 2106 in the transmission line 2104 is coupled to the antenna elements 2102 when the antenna is transmitting, and from the antenna elements 2102 when the antenna is receiving. Each of the antenna elements 2102 is coupled to the transmission line 2104 through an amplitude controlling switch 2108. The switches 2108 are digitally controlled and, in many implementations, are binary switches. The states of the switches 2108 are generally computer controlled with each switch set according to a desired beam shape and direction.

Figure 22:
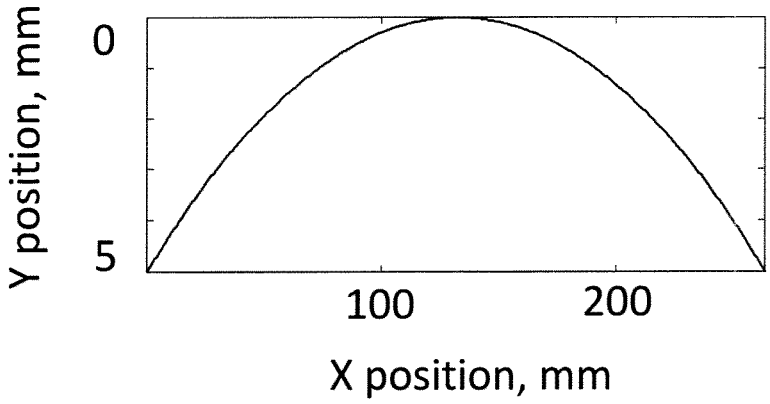
FIG. 22 is a graph of pixel locations for the beam-forming antenna of FIG. 21.

Like the antenna 1500 described above and illustrated in FIG. 15, the antenna elements 2102 are advantageously uniformly spaced (i.e., the antenna has uniform pixel spacing). To address the problem of high-magnitude Q-lobes, the antenna elements 2102 are arranged in a non-linear array, specifically a parabolic arc. FIG. 22 is a graph of antenna element locations for the beam-forming antenna of FIG. 21. FIG. 22 illustrate the location of antenna elements 2102 with the position in a direction generally parallel to the transmission line 2104 on the x-axis and the direction generally in the direction of the electromagnetic radiation on the y-axis. From a reference position at the center of the antenna elements, the antenna elements are positioned increasingly outward according to a parabolic curve. In other embodiments, the locations of the antenna elements may be increasingly inward towards the edges of the antenna, and, in some embodiments, the locations may not be symmetrical about the center of the antenna.

Figure 23:
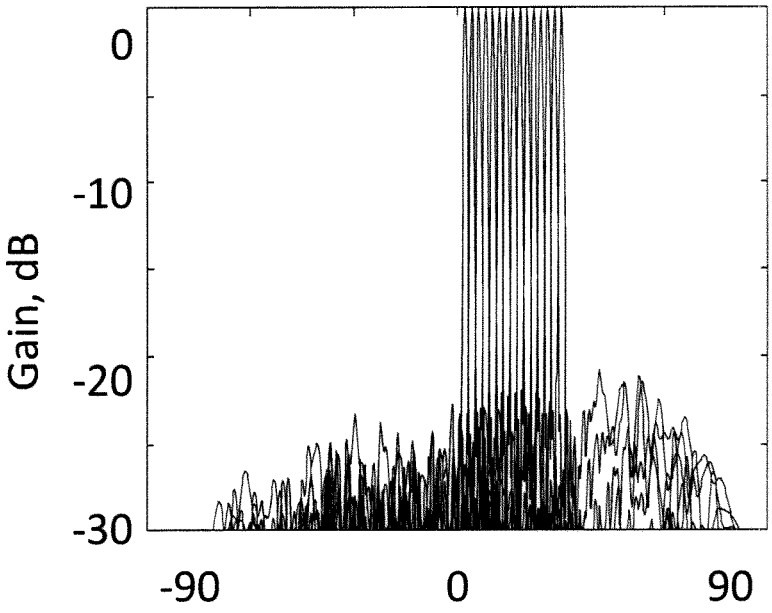
FIG. 23 shows an exemplary far-field beam shapes produced by the beam-forming antenna of FIG. 21.

FIG. 23 illustrates exemplary far-field beam shapes for a scan of beam directions for the antenna of FIG. 21. The illustrated beam shapes are for an exemplary antenna with binary switches, uniform pixel pitches of approximately one-seventh the wavelength of the electromagnetic radiation, approximately 500 antenna elements, and a transmission line with a refractive index of approximately 1.35. Sixteen beam directions separated by two degrees are superimposed in FIG. 23. The Q-lobes vary in magnitude, with all attenuated greater than 20 dB relative to the main lobes.

Figure 24:
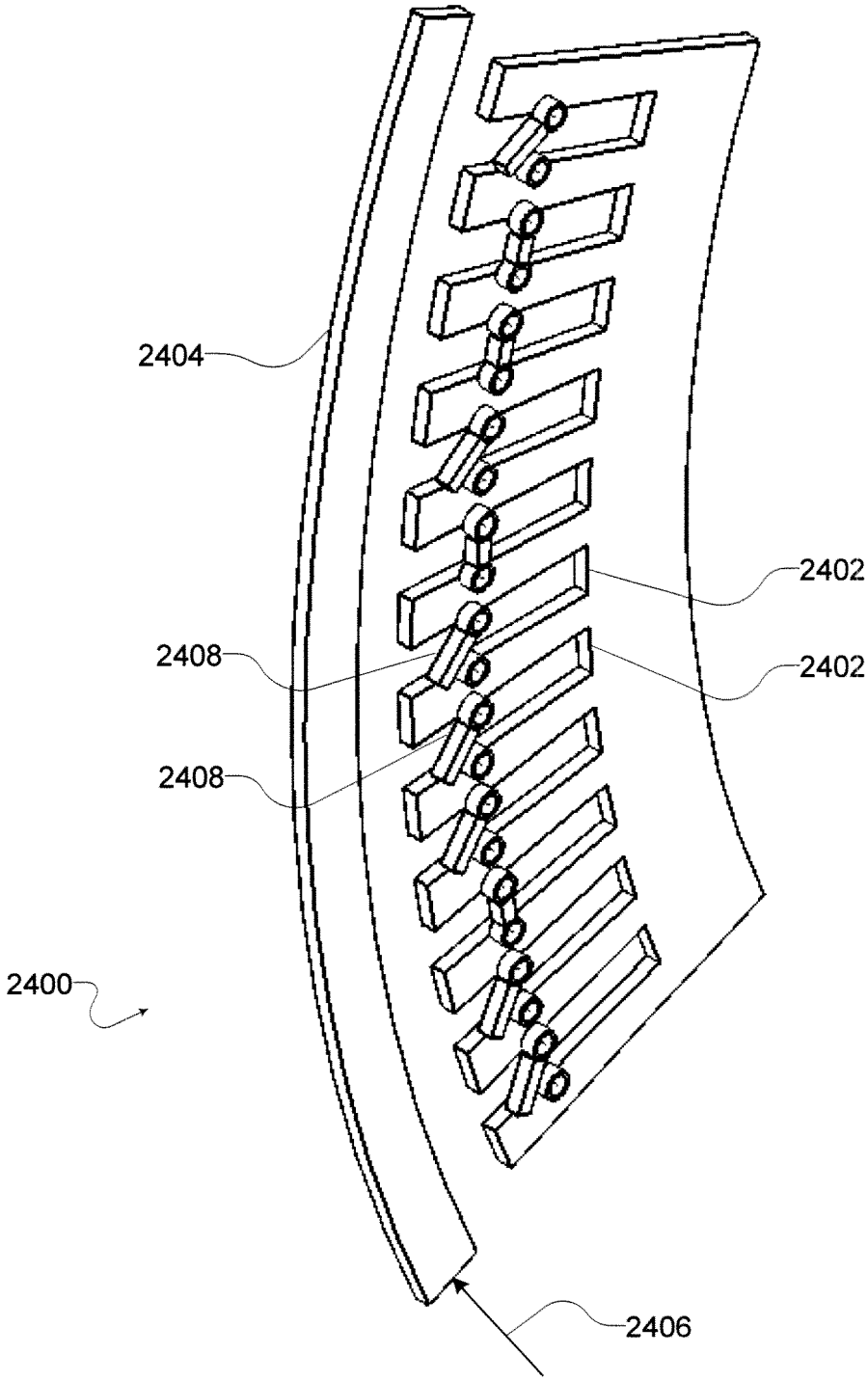
FIG. 24 is a semi-diagrammatic view of a beam-forming antenna in accordance with a further embodiment of the present invention.

FIG. 24 is a semi-diagrammatic view of another embodiment of a beam-forming antenna 2400 in accordance with an aspect of the present invention. The antenna 2400 is similar to the antenna 2100 shown in FIG. 21, and it includes an array of individual antenna elements 2402, a transmission line 2404, and switches 2408 arranged as described above for the corresponding components of the antenna 2100 of FIG. 21. Like the antenna 2100 of FIG. 21, the antenna 2400 employs uniform pixel spacing, and it addresses the Q-lobe problem by arranging the antenna elements in a non-linear array. In this embodiment, the antenna elements 2402 are arranged in a circular arc.

Figure 25:
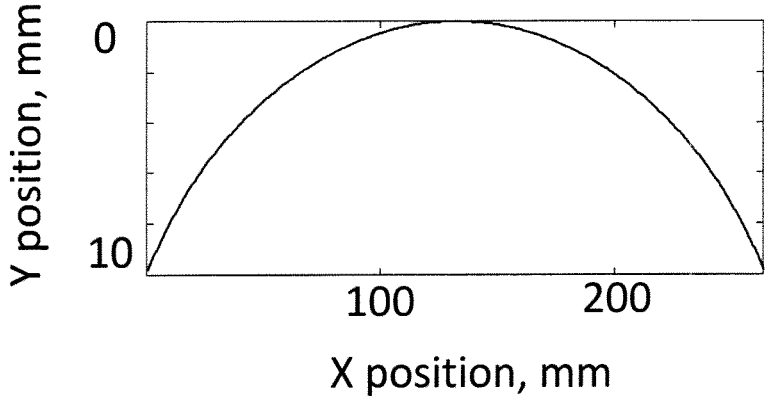
FIG. 25 is a graph of pixel locations for the beam-forming antenna of FIG. 24.

FIG. 25 is a graph of antenna element locations for the beam-forming antenna 2400. From a reference position at the center of the antenna elements, the antenna elements are positioned increasingly outward according to a circular curve. In other embodiments, the locations of the antenna elements be increasingly inward towards the edges of the antenna, and, in some embodiments, the locations may not be symmetrical about the center of the antenna.

Figure 26:
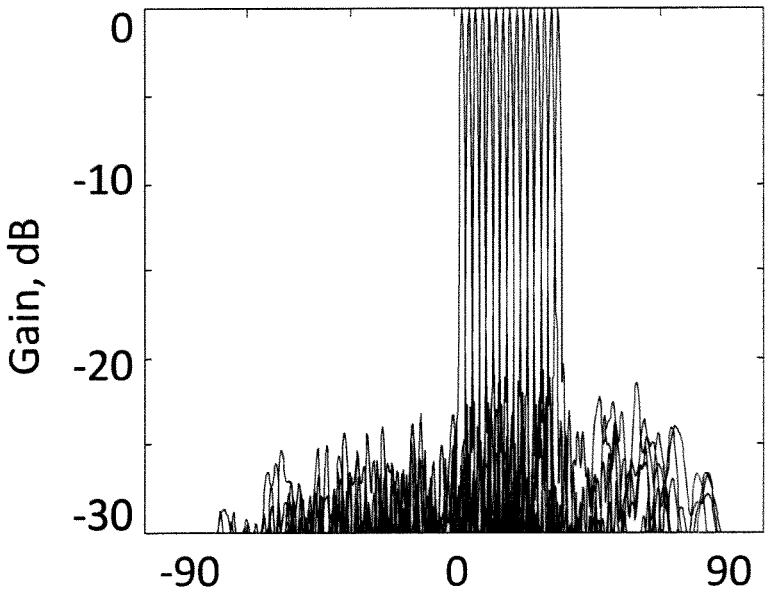
FIG. 26 shows an exemplary far-field beam shapes produced by the beam-forming antenna of FIG. 24.

FIG. 26 illustrates exemplary far-field beam shapes for a scan of beam directions for the antenna of FIG. 24. The illustrated beam shapes are for an exemplary antenna with binary switches, uniform pixel pitches of approximately one-seventh the wavelength of the electromagnetic radiation, approximately 500 antenna elements, and a transmission line with a refractive index of approximately 1.35. Sixteen beam directions separated by two degrees are superimposed in FIG. 26. The Q-lobes vary in magnitude, with all attenuated greater than 20 dB relative to the main lobes.

Figure 27:
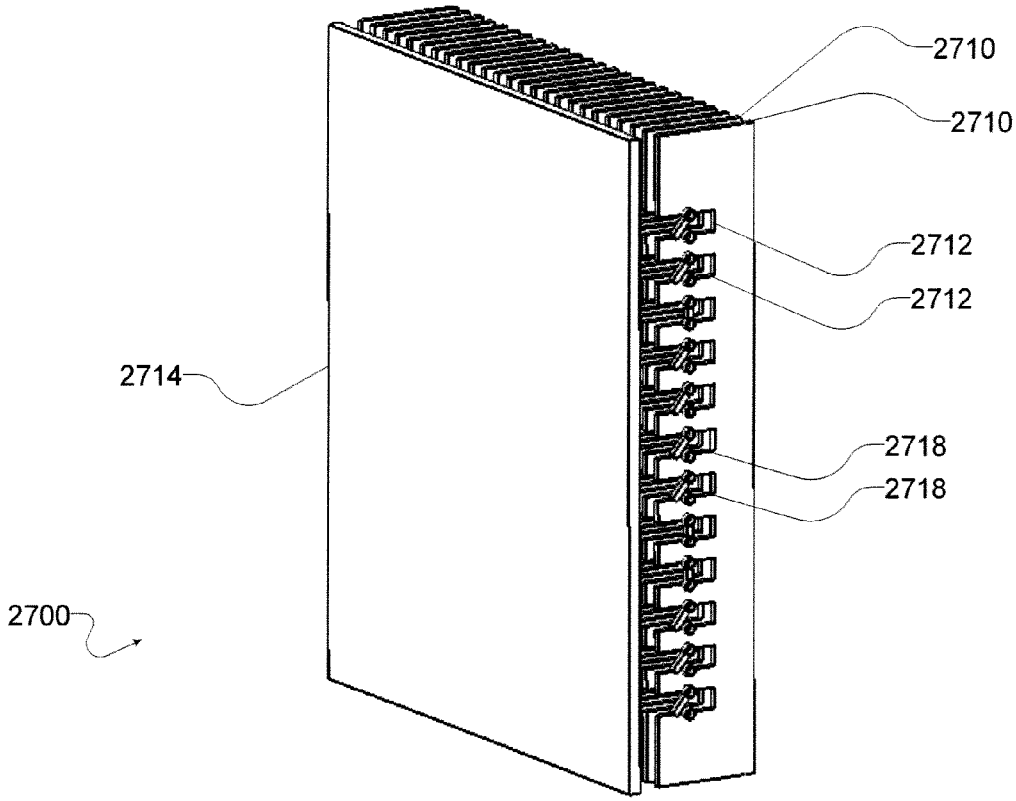
FIG. 27 is a semi-diagrammatic view of one embodiment of a surface-array beam-forming antenna in accordance with an aspect of the present invention.

FIG. 27 is a semi-diagrammatic view of an embodiment of a surface-array beam-forming antenna 2700 in accordance with an aspect of the present invention. The antenna 2700 provides beam-shaping in three dimensions, the beam's direction being typically described by an azimuth angle and an elevation angle. The antenna 2700 includes a plurality of antenna-element arrays 2710. Each of the antenna-element arrays 2710, in some embodiments, may advantageously be similar to or the same as the antenna 1500 of FIG. 15.

Each antenna-element array 2710 includes antenna elements 2712 and switches 2718 arranged as described above for the corresponding components of the antenna of FIG. 15. The antenna-element arrays 2710 are coupled to a transmission line 2714 for supplying or receiving a signal. The transmission line 2714 is coupled to the antenna elements as described above for the antenna of FIG. 15. The antenna-element arrays 2710 are arranged in parallel.

Figure 28:
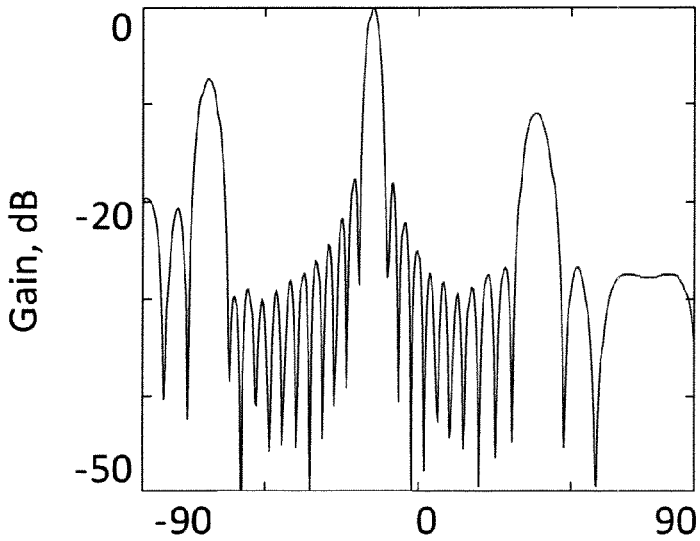
FIG. 28 shows an exemplary far-field beam shape produced by the beam-forming antenna of FIG. 27.

FIG. 28 illustrates an exemplary far-field beam shape produced by the beam-forming antenna of FIG. 27. The illustrated shape is for an exemplary antenna having approximately 45 antenna-element arrays, a spacing between antenna-element arrays of approximately one-half the wavelength of the electromagnetic radiation, approximately 500 antenna elements per antenna-element array, a pixel pitch of approximately one-quarter the wavelength of the electromagnetic radiation, binary switches, and a transmission line with a refractive index of approximately 1.35. FIG. 28 shows an elevation angle on the x-axis and a gain in decibels on the y-axis. The beam shape is for when the switches are set for an angle of −14°. In addition to a main lobe, there are many side lobes, some of which are attenuated by approximately only 8 dB relative to the main lobe.

Figure 29:
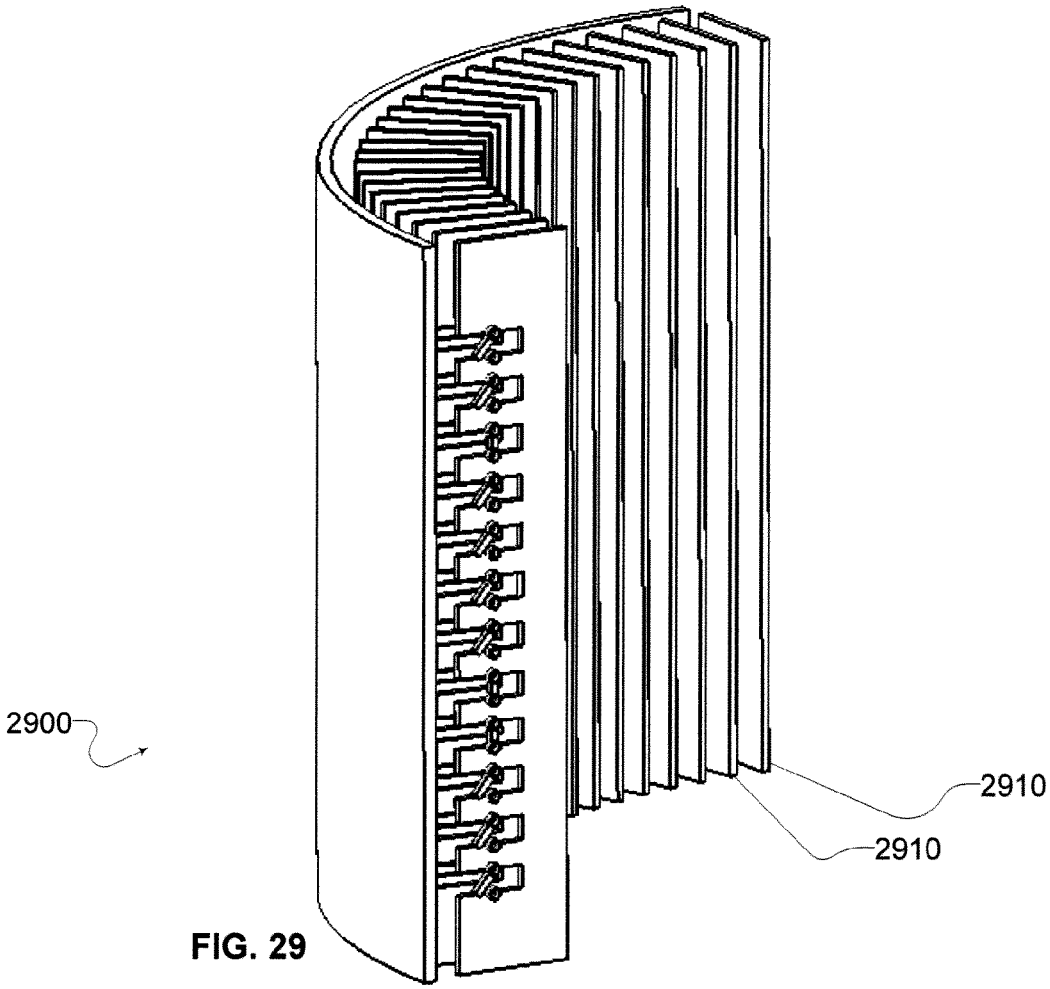
FIG. 29 is a semi-diagrammatic view of another embodiment of a surface-array beam-forming antenna in accordance with the present invention.

FIG. 29 is a semi-diagrammatic view of another embodiment of a surface-array beam-forming antenna 2900 in accordance with an aspect of the present invention. The antenna 2900 is similar to the antenna of FIG. 27 and provides beam-shaping in three dimensions. The antenna 2900 includes a plurality of antenna-element arrays 2910. The antenna-element arrays 2910 are, in some embodiments, similar to or the same as the antenna elements of FIG. 27.

Figure 30:
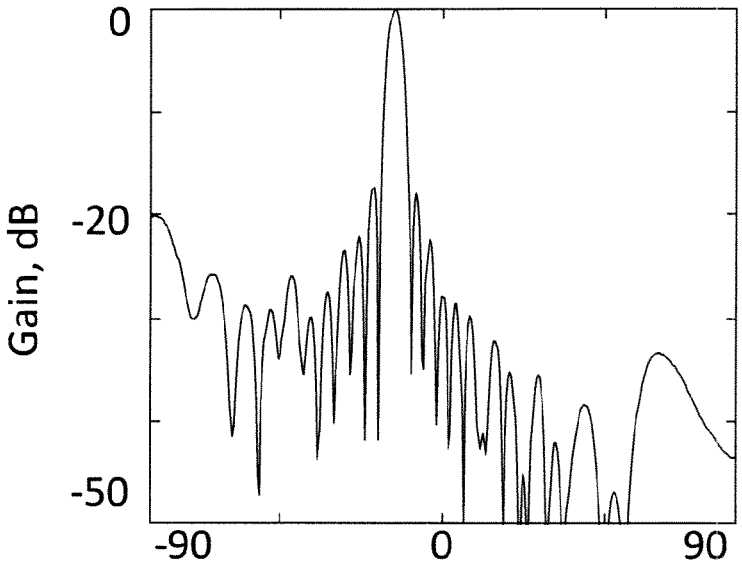
FIG. 30 shows an exemplary far-field beam shape produced by the beam-forming antenna of FIG. 29.

To achieve improved Q-lobe suppression or attenuation as compared to the antenna 2700 of FIG. 27, the antenna-element arrays 2910 of the antenna 2900 are arranged cylindrically. That is, each of the antenna-element arrays 2910 is positioned perpendicular to a cylindrical surface. This result is shown in FIG. 30, which illustrates an exemplary far-field beam shape produced by the beam-forming antenna of FIG. 28. The illustrated shape is for an exemplary antenna having approximately 45 antenna-element arrays arranged on a cylinder with a radius of approximately fourteen times the wavelength of the electromagnetic radiation, a spacing between antenna-element arrays of approximately one-half the wavelength of the electromagnetic radiation, approximately 500 antenna elements per antenna-element array, a pixel pitch of approximately one-quarter the wavelength of the electromagnetic radiation, binary switches, and a transmission line with a refractive index of approximately 1.35. FIG. 30 shows an elevation angle on the x-axis and a gain in decibels on the y-axis. The beam shape is for when the switches are set for an angle of −14°. In addition to a main lobe, there are many side lobes, all which are attenuated by greater than 20 dB relative to the main lobe. By comparison to FIG. 28, it is seen that Q-lobe attenuation is improved by more than 12 dB using a cylindrical arrangement of antenna elements relative to using planar arrangement.

Figure 31:
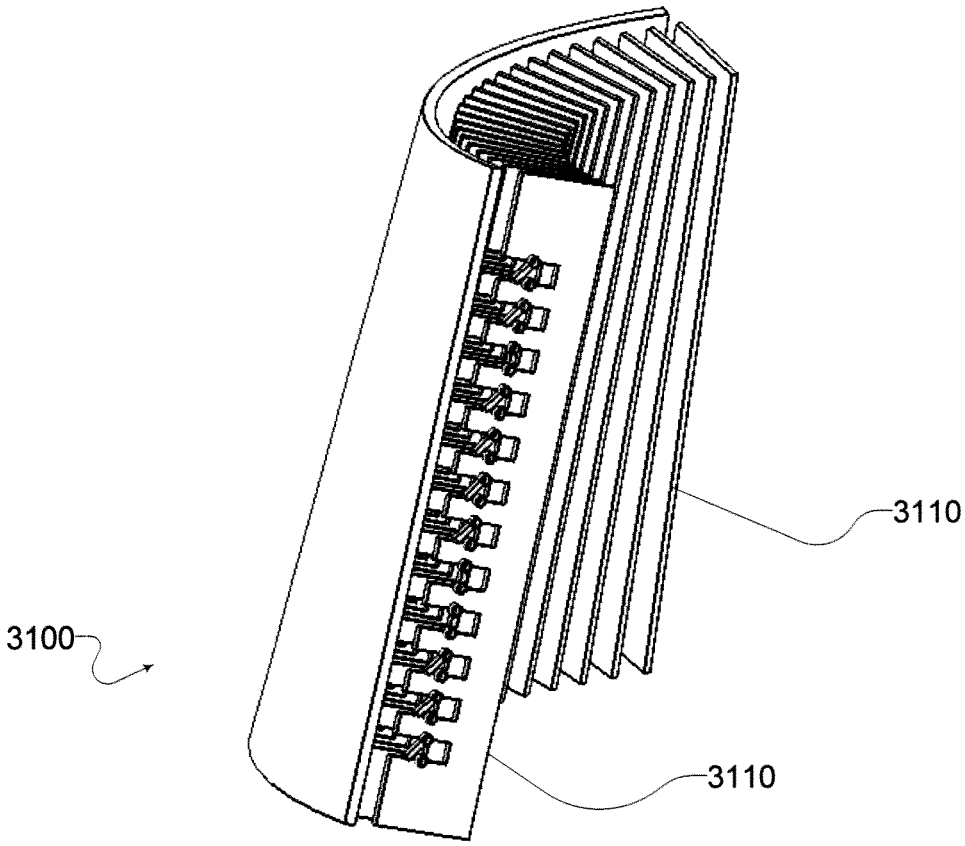
FIG. 31 is a semi-diagrammatic view of still another embodiment of a surface-array beam-forming antenna in accordance with the present invention.

FIG. 31 is a semi-diagrammatic view of another embodiment of a surface-array beam-forming antenna 3100 in accordance with the present invention. The antenna 3100 is similar to the antenna 2900 of FIG. 29. The antenna 3100 includes a plurality of antenna-element arrays 3110. However, the antenna-element arrays 3110 of the antenna 3100 are arranged conically. That is, each of the antenna-element arrays 3110 is positioned perpendicular to the surface of a cone.

Figure 32:
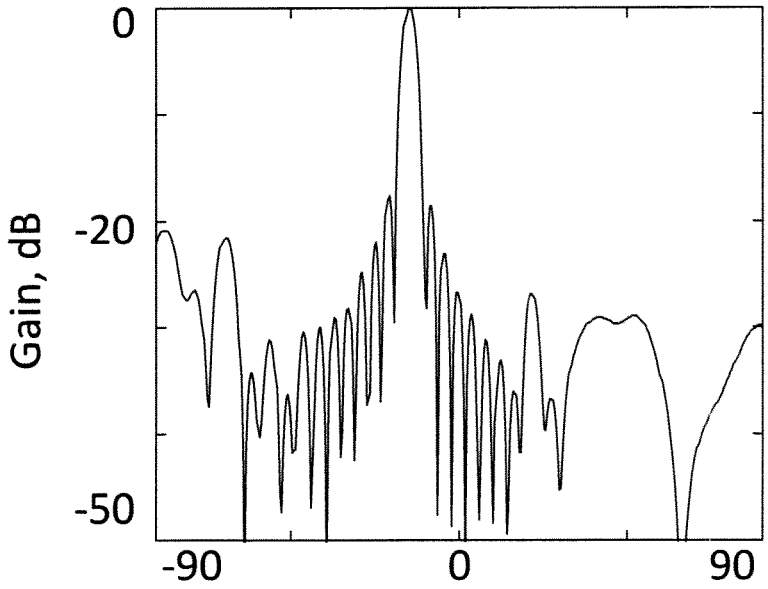
FIG. 32 shows an exemplary far-field beam shape produced by the beam-forming antenna of FIG. 31.

FIG. 32 illustrates an exemplary far-field beam shape produced by the beam-forming antenna of FIG. 31. The illustrated shape is for a particular exemplary antenna having the same general characteristics as the antenna described above in connection with FIG. 30. In this embodiment, however, the particular antenna has a cone angle of 15°. FIG. 32 shows an elevation angle on the x-axis and a gain in decibels on the y-axis. The beam shape is for when the switches are set for an angle of −14°. In addition to a main lobe, there are many side lobes, all which are attenuated by greater than 20 dB relative to the main lobe.

From the foregoing description and examples, it will be appreciated that the present invention provides a beam-forming antenna that offers highly-controllable beam-shaping capabilities, wherein all beam shape parameters (angular location of the beam's power peak, the beamwidth of the power peak, and side lobe distribution) can be controlled with essentially the same precision as in phased array antennas, but at significantly reduced manufacturing cost, and with significantly enhanced operational stability.

While exemplary embodiments of the invention have been described herein, including those embodiments encompassed within what is currently contemplated as the best mode of practicing the invention, it will be apparent to those skilled in the pertinent arts that a number of variations and modifications of the disclosed embodiments may suggest themselves to such skilled practitioners. For example, as noted above, amplitude controlling devices that are functionally equivalent to those specifically described herein may be found to be suitable for practicing the present invention. Furthermore, even within the specifically-enumerated categories of devices, there will be a wide variety of specific types of components that will be suitable. For example, in the category of switches, there is a wide variety of semiconductor switches, optical switches, solid state switches, etc. with various amplitude gradations that may be employed. In addition, a wide variety of transmission lines (e.g., waveguides) and antenna elements (e.g., dipoles) may be employed in the present invention. Furthermore, aspect of described embodiments may be combined, for example, an antenna may have both non-uniformly spaced antenna elements and a curved positioning of the antenna elements. These and other variations and modifications that may suggest themselves are considered to be within the spirit and scope of the invention, as defined in that claims that follow.

What is claimed is:

1. A beam-forming antenna comprising:

an array of antenna elements;

a transmission line electromagnetically coupled to the array of antenna elements, whereby an electromagnetic signal is communicated between the transmission line and each of the antenna elements in the array; and binary control means operable to provide one-bit digital control of the amplitude of the electromagnetic signal communicated between each of the antenna elements in the array and the transmission line in accordance with a set of binary amplitude values, each of which corresponds to one of the antenna elements in the array, whereby an amplitude distribution is produced along the array that results in a desired beam direction and shape for the electromagnetic signal without controlled phase-shifting of the electromagnetic signal between the transmission line and the antenna elements.

2. The beam-forming antenna of claim 1, wherein the antenna elements in the array are arranged linearly between a first end and a second end, wherein the electromagnetic signal has a selected wavelength, and wherein the antenna elements in the array are separated from each other by spacing distances that vary in accordance with a parabolic distribution between the first end and the second end, with none of the spacing distances exceeding one-third the selected wavelength.

3. The beam-forming antenna of claim 1, wherein the antenna elements in the array are arranged linearly between a first end and a second end, wherein the electromagnetic signal has a selected wavelength, and wherein the antenna elements in the array are separated from each other by spacing distances that vary in accordance with a sinusoidal distribution between the first end and the second end, with none of the spacing distances exceeding one-third the selected wavelength.

4. The beam-forming antenna of any of claims 1-3, wherein the binary control means comprises a binary switching device operatively associated with each of the antenna elements.

5. The beam-forming antenna of claim 4, wherein the binary switching devices are operated under the control of a computer program that produces the set of binary amplitude values.

6. The beam-forming antenna of claim 1, wherein the antenna elements are arranged in a parabolic configuration, wherein the electromagnetic signal has a selected wavelength, and wherein the antenna elements are separated from each other by a spacing distance that does not exceed one-third the selected wavelength.

7. The beam-forming antenna of claim 1, wherein the antenna elements are arranged along an arc of a circle, wherein the electromagnetic signal has a selected wavelength, and wherein the antenna elements are separated from each other by a spacing distance that does not exceed one-third the selected wavelength.

8. The beam-forming antenna of either of claim 6 or 7, wherein the spacing distances are approximately equal.

9. The beam-forming antenna of either of claim 6 or 7, wherein the binary control means comprises a binary switching device operatively associated with each of the antenna elements.

10. The beam-forming antenna of claim 9, wherein the binary switching devices are operated under the control of a computer program that produces the set of binary amplitude values.

11. The beam-forming antenna of claim 1, wherein the array of antenna elements is a first array, wherein the antenna further comprises at least a second array of antenna elements that is spaced from the first array and a transmission line electromagnetically coupled to each of the arrays of antenna elements; and wherein the binary control means is operable to provide one-bit digital control of the amplitude of the electromagnetic signal communicated between each of the antenna elements in the first and second arrays and the transmission line coupled thereto in accordance with a set of binary amplitude values, each of which corresponds to one of the antenna elements in the first and second arrays, whereby an amplitude distribution is produced along the first and second arrays that results in a desired beam shape for the electromagnetic signal.

12. The beam-forming antenna of claim 11, wherein the electromagnetic signal has a selected wavelength, wherein the first and second arrays are separated from each other by a distance that does not exceed one-half the selected wavelength, wherein the antenna elements in each of the arrays are arranged linearly between a first end and a second end, and wherein the antenna elements in each of the arrays are separated from each other by spacing distances that vary in accordance with a parabolic distribution between the first end and the second end, with none of the spacing distances exceeding one-third the selected wavelength.

13. The beam-forming antenna of claim 11, wherein the electromagnetic signal has a selected wavelength, wherein the first and second arrays are separated from each other by a distance that does not exceed one-half the selected wavelength, wherein the antenna elements in each of the arrays are arranged linearly between a first end and a second end, and wherein the antenna elements in each of the arrays are separated from each other by spacing distances that vary in accordance with a sinusoidal distribution between the first end and the second end, with none of the spacing distances exceeding one-third the selected wavelength.

14. The beam-forming antenna of any of claims 11-13, wherein the binary control means comprises a binary switching device operatively associated with each of the antenna elements.

15. The beam-forming antenna of claim 14, wherein the binary switching devices are operated under the control of a computer program that produces the set of binary amplitude values.

16. The beam-forming antenna of claim 11, wherein the antenna elements in each of the arrays are arranged in a parabolic configuration, wherein the electromagnetic signal has a selected wavelength, wherein the first and second arrays are separated from each of the by a distance that does not exceed one-half the selected wavelength, and wherein the antenna elements are separated from each other by a spacing distance that does not exceed one-third the selected wavelength.

17. The beam-forming antenna of claim 16, wherein the spacing distances are approximately equal.

18. The beam-forming antenna of claim 11, wherein the antenna elements are arranged along an arc of a circle, wherein the electromagnetic signal has a selected wavelength, wherein the first and second arrays are separated from each of the by a distance that does not exceed one-half the selected wavelength, and wherein the antenna elements are separated from each other by a spacing distance that does not exceed one-third the selected wavelength.

19. The beam-forming antenna of claim 18, wherein the spacing distances are approximately equal.

20. The beam-forming antenna of any of claims 16-19, wherein the binary control means comprises a binary switching device operatively associated with each of the antenna elements.

21. The beam-forming antenna of claim 20, wherein the binary switching devices are operated under the control of a computer program that produces the set of binary amplitude values.

22. A method of controlling the beam shape of an electromagnetic signal having a selected wavelength that is transmitted or received by a plurality of antenna elements in an array of antenna elements that are electromagnetically coupled to a transmission line, wherein the method comprises the step of controllably switching the signal coupled between the transmission line and each antenna element in the array of antenna elements between an ON state and an OFF state in accordance with a set of binary amplitude values, each of which corresponds to one of the antenna elements, whereby an amplitude distribution is produced along the array that results in a desired beam direction and shape for the electromagnetic signal without controlled phase-shifting of the electromagnetic signal between the transmission line and the antenna elements.

23. The method of claim 22, wherein the step of controllably switching the signal is performed by a plurality of switching devices, each of which is operatively associated with one of the antenna elements.

24. The method of claim 23, wherein the switching devices are operated under the control of a computer program that produces the set of binary amplitude values.

25. A reconfigurable, directional antenna, operable for both transmission and reception of an electromagnetic signal having a selected wavelength, the antenna comprising:

an array of switchable antenna elements, each of which is operable to be switched between an ON state and an OFF state in accordance with a set of binary amplitude values, each of the values corresponding to one of the antenna elements, whereby an amplitude distribution is produced along the array that results in a desired beam shape and direction for the electromagnetic signal without controlled phase-shifting of the electromagnetic signal between the transmission line and the antenna elements; and a transmission line arranged for electromagnetically coupling the electromagnetic signal to and from the array of antenna elements.

26. The antenna of claim 25, wherein the antenna elements in the array are arranged linearly between a first end and a second end, and wherein the antenna elements in the array are separated from each other by spacing distances that vary in accordance with a parabolic distribution between the first end and the second end, with none of the spacing distances exceeding one-third the selected wavelength.

27. The antenna of claim 25, wherein the antenna elements in the array are arranged linearly between a first end and a second end, and wherein the antenna elements in the array are separated from each other by spacing distances that vary in accordance with a sinusoidal distribution between the first end and the second end, with none of the spacing distances exceeding one-third the selected wavelength.

28. The antenna of any of claims 25-27, wherein the switching of the antenna elements is provided by binary control means operable to provide one-bit digital control of the amplitude of the electromagnetic signal communicated between each of the antenna elements in the array and the transmission line in accordance with the set of binary amplitude values.

29. The antenna of claim 28, wherein the binary control means comprises a binary switching device operatively associated with each of the antenna elements.

30. The antenna of claim 29, wherein the binary switching devices are operated under the control of a computer program that produces the set of binary amplitude values.

31. The beam-forming antenna of claim 25, wherein the antenna elements are arranged in a parabolic configuration, and wherein the antenna elements are separated from each other by a spacing distance that does not exceed one-third the selected wavelength.

32. The antenna of claim 25, wherein the antenna elements are arranged along an arc of a circle, and wherein the antenna elements are separated from each other by a spacing distance that does not exceed one-third the selected wavelength.

33. The antenna of either of claim 31 or 32, wherein the spacing distances are approximately equal.

34. The antenna of either of claim 31 or 32, wherein the switching of the antenna elements is provided by binary control means operable to provide one-bit digital control of the amplitude of the electromagnetic signal communicated between each of the antenna elements in the array and the transmission line in accordance with the set of binary amplitude values.

35. The antenna of claim 34, wherein the binary control means comprises a binary switching device operatively associated with each of the antenna elements.

36. The antenna of claim 35, wherein the binary switching devices are operated under the control of a computer program that produces the set of binary amplitude values.

* * * * *

UNITED STATES PATENT AND TRADEMARK OFFICE

CERTIFICATE OF CORRECTION

PATENT NO. : 8,456,360 B2
APPLICATION NO. : 12/981326
DATED : June 4, 2013
INVENTOR(S) : Vladimir A. Manasson et al.

It is certified that error appears in the above-identified patent and that said Letters Patent is hereby corrected as shown below:

In the Specification

In column 5, line 30, after "form" delete "in".

In column 7, line 66, delete "with parabolic" and insert -- with a parabolic --, therefor.

Signed and Sealed this
Twenty-sixth Day of November, 2013

Margaret A. Focarino

Margaret A. Focarino
*Commissioner for Patents of the United States Patent and Trademark Office*